United States Patent [19]

Ishigaki et al.

[11] Patent Number: 5,045,883

[45] Date of Patent: Sep. 3, 1991

[54] IMAGE DENSITY CONTROL METHOD USING EXCLUSIVE PATTERNS FOR AN IMAGE FORMING APPARATUS

[75] Inventors: Kouji Ishigaki, Yokohama; Yasuji Takagi, Matsudo, both of Japan

[73] Assignee: Ricoh Company, Ltd., Japan

[21] Appl. No.: 442,503

[22] Filed: Nov. 28, 1989

[30] Foreign Application Priority Data

Dec. 1, 1988 [JP] Japan ..... 63-302305

[51] Int. Cl.[5] ..... G03G 21/00

[52] U.S. Cl. ..... 355/214; 118/665; 355/246; 430/30

[58] Field of Search ..... 355/208, 214, 246; 118/665, 664, 688, 689-691; 430/30

[56] References Cited

U.S. PATENT DOCUMENTS 4,277,162 7/1981 Kasahara et al. ..... 355/246 X
4,572,654 2/1986 Murai et al. ..... 355/214
4,647,184 3/1987 Russell et al. ..... 355/208

FOREIGN PATENT DOCUMENTS 0037731 10/1981 European Pat. Off. ..... 355/208
0125755 7/1984 Japan ..... 355/208
0174862 10/1984 Japan ..... 355/208

*Primary Examiner*—Fred L. Braun
*Assistant Examiner*—William J. Royer
*Attorney, Agent, or Firm*—Mason, Fenwick & Lawrence

[57] ABSTRACT

An image density control method for an image forming apparatus for forming a plurality of exclusive patterns on a photoconductive element, or image carrier, and controlling an image forming condition based on the exclusive patterns so as to control image density. The exclusive patterns include a high density black pattern and a low density white pattern. While a scanner included in the apparatus is brought to and held at a predetermined position, a latent image of the low densit white pattern is electrostatically formed on the photoconductive element. While the scanner is in a reciprocating motion, a latent image of the high density black pattern is formed on the photoconductive element. The plurality of patterns formed on the photoconductive element are sensed to correct toner density and background output based on sensed values, whereby accurate image density control is promoted.

7 Claims, 32 Drawing Sheets

Fig. 7

| ROTATION / POSITION | 1ST | 2ND | 3RD | 4TH | 5TH | 6TH | MEAN VALUE OF 1ST TO 6TH |
|---|---|---|---|---|---|---|---|
| (1) | 3.63 | 4.14 | 4.02 | 3.41 | 3.57 | 4.04 | |
| (2) | 3.70 | 4.20 | 4.00 | 3.49 | 3.63 | 3.94 | |
| (3) | 4.02 | 3.88 | 3.84 | 3.75 | 3.84 | 3.67 | |
| (4) | 4.23 | 3.71 | 3.69 | 3.98 | 4.24 | 3.80 | |
| (5) | 4.08 | 3.76 | 3.63 | 4.10 | 4.12 | 3.94 | |
| (6) | 3.76 | 3.92 | 3.84 | 3.75 | 3.78 | 4.02 | |
| MEAN VALUE OF (1) ~ (6) | 3.90 | 3.94 | 3.84 | 3.75 | 3.86 | 3.90 | $\bar{x}$ =3.865 |
| | | | | | | | $\delta$ =0.07 |

0pls
100
200
300
400
500
600
(700)
(800)
(900)
(1000)
(1100)
(1200)
(1300)
MAIN MOTOR
CHARGE
TRANSFER
SEPARATION
PCC
PQC/BR
QL.PTL
LAMP
SCANNER
ERASE
BIAS VOLTAGE
PHOTOSENSOR LED
PHOTOSENSOR TR
(750)
(1030)
(671)
(1070)
(671)
(1070)
(671)
(1220)
(650)
(671)
(1030)
SAME AS FORMING PHOTOSENSOR PATTERN
ERASURE FOR NORMAL DENSITY CONTROL
SENSE VSST & VSCK
REPETIVELY CHANGE BIAS VOLTAGE UNTIL VSST/3.0V ≦ VSST ≦ VSGS HOLDS
SENSE VSGS, VSGC
PATTERN FOR NORMAL DENSITY CONTROL
(870)
(1070)
220
420
(40pls INTERVAL)
(40pls INTERVAL)

| Fig.24A |
| --- |
| Fig.24B |

PW091
A ← VSST-VSCK
(27-1)
VSP/VSG > 6/40 ?
(27-2)
YES
NO
(LOW TONER DENSITY)
VSP/VSG > 3/40 ?
(27-3)
NO
(HIGH TONER DENSITY)
YES
(27-4)
A > 0 ?
(27-5)
A>0.53V?
(27-6)
A>1.06V?
(27-7)
A>1.59V?
(27-8)
A>2.0V?
(27-10)
A > 0 ?
(27-11)
A>0.61V?
(27-12)
A>1.21V?
(27-13)
A>1.82V?
(27-14)
A>2.3V ?
(27-15)
A > 0 ?
(27-16)
A>0.46V?
(27-17)
A>0.93V?
(27-18)
A>1.40V?
(27-19)
A>1.75V?
NO
YES
I
II
III
IV

Fig. 29

| NO | ITEM | DATA VARYING FROM PW050 TO PW056 | | | | | |
|---|---|---|---|---|---|---|---|
| | | 0° | 60° | 120° | 180° | 240° | 300° |
| * 1 | LOWER LIMIT OF DRUM PULSE COUNTER | 219 | 259 | 299 | 339 | 379 | 419 |
| * 2 | UPPER LIMIT OF DRUM PULSE COUNTER | 232 | 272 | 312 | 352 | 392 | 432 |
| * 3 | NUMBER OF TIMES | 00H | 01H | 02H | 03H | 04H | 05H |
| * 4 | ADDRESS OF OUTPUT DATA | DPSTL1 (0C19911) | DPSTL2 ( A) | DPSTL3 ( B) | DPSTL4 ( C) | DPSTL5 ( D) | DPSTL6 (0C19E11) |
| * 5 | NEXT READ FLAG | 01H | 02H | 03H | 04H | 05H | 00H |

IMAGE DENSITY CONTROL METHOD USING EXCLUSIVE PATTERNS FOR AN IMAGE FORMING APPARATUS

BACKGROUND OF THE INVENTION

The present invention relates to an image forming apparatus and, more particularly, to an image density control method for an image forming apparatus which controls image density by controlling an image forming condition on the basis of a plurality of exclusive pattern for control formed on a photoconductive element, or image carrier.

A prerequisite with an electrophotographic copier, facsimile machine, printer or similar image forming apparatus is that high quality images having stable density be produced over a long period of time. In an electrophotographic copier, for example, a photoconductive element is often implemented as an OPC or a selenium-based organic photoconductive element. An OPC type photoconductive element in particular has a problem that the potential disposited in a low potential area thereof (white area) is susceptible to a change in ambient temperature or the deterioration of the element and has substantial influence on the image forming conditions. In the light of this, a copier of the type described is provided with various image density control devices such as a toner density control device. Specifically, it is a common practice to form an exclusive pattern (black pattern) for controlling image forming conditions on a photoconductive element, to sense the exclusive pattern by a sensor, and to control image forming conditions on the basis of an output of the sensor. Such a pattern is formed on a photoconductive element while holding a scanner in a halt, as disclosed in Japanese Patent Laid-Open Publication (Kokai) No. 59-2058 by way of example.

The image forming conditions are effected not only by the change in the potential deposited in a low potential area of a photoconductive element but also by the eccentricity of the element. Specifically, eccentricity of a photoconductive element renders the sensed value associated with the exclusive pattern unstable. To reduce the influence of such factors, a plurality of exclusive patterns for control may be formed at different positions on a photoconductive element. The above-stated prior art, however, cannot implement the multiple pattern scheme because it forms a pattern while maintaining a scanner in a halt.

SUMMARY OF THE INVENTION

It is therefore an object of the present invention to provide an image density control method for an image forming apparatus capable of controlling an image forming condition and, therefore, image density by forming a plurality of patterns on an image carrier.

In is another object of the present invention to provide a generally improved image density control method for an image forming apparatus.

An image density control method for an image forming apparatus having optics which is constituted by a scanner for forming an exclusive pattern having a predetermined density on an image carrier and controlling an image forming condition on the basis of the exclusive pattern of the present invention comprises the steps of preparing a plurality of exclusive patterns for controlling the image forming condition, moving the scanner of the optics to a predetermined position and stopping the scanner at the predetermined position, electrostatically forming a latent image representative of one of the plurality of patterns on the image carrier while the scanner is held in a stop, causing the scanner into a reciprocating movement between the predetermined position and a home position of the scanner, and electrostatically forming a latent image representative of the other pattern on the image carrier while the scanner is moved in a reciprocating motion.

BRIEF DESCRIPTION OF THE DRAWINGS

The above and other objects, features and advantages of the present invention will become more apparent from the following detailed description taken with the accompanying drawings in which:

FIG. 7 is a table listing specific numerical values which may result from the measurement effected at the sensing positions of FIG. 6;

FIG. 29 is a table showing data associated with the flowchart of FIG. 18;

DESCRIPTION OF THE PREFERRED EMBODIMENT

Figure 1:
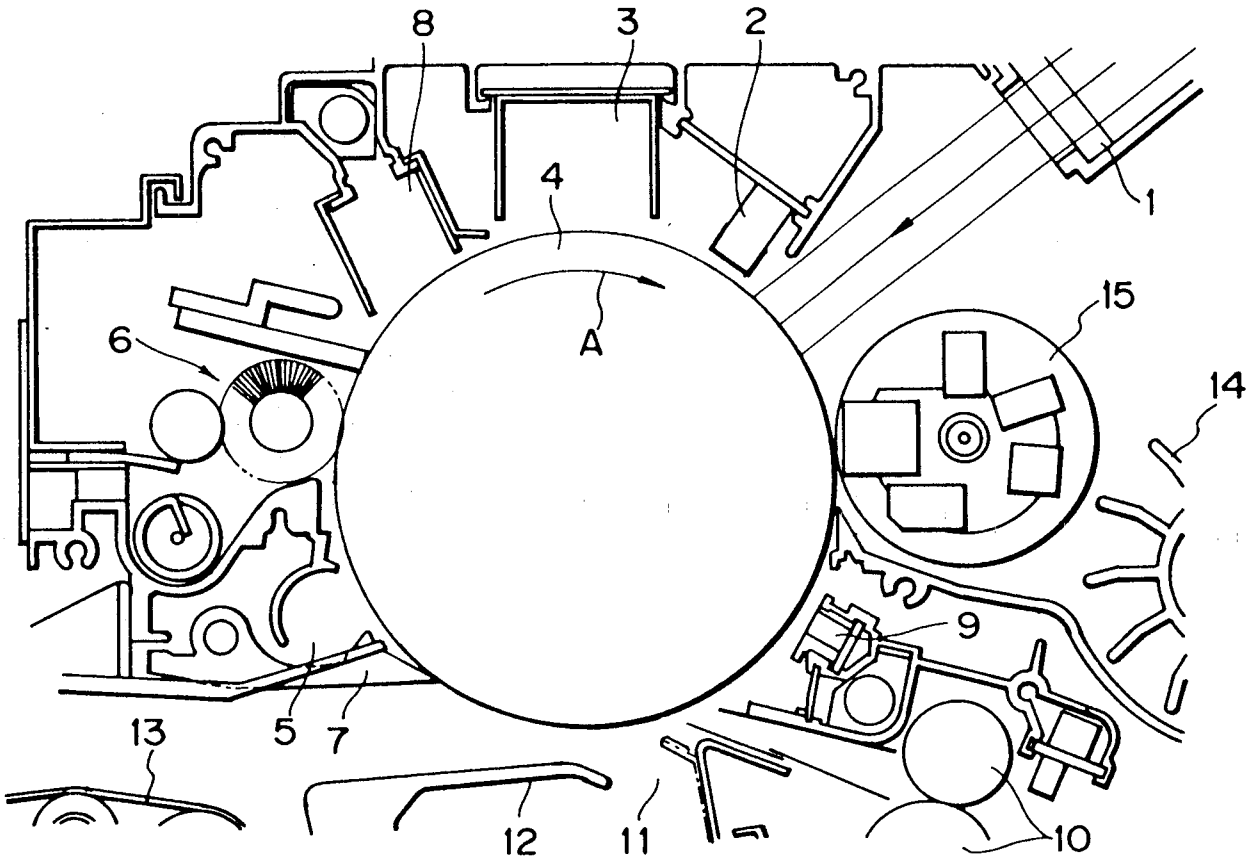
FIG. 1 is a schematic front view of a copier belonging to a family of image forming apparatuses to which the present invention is applicable.

Referring to FIG. 1 of the drawings, a copier representative of and image forming apparatus to which the present invention is applicable is shown. As shown, the copier has a dust-proof glass 1 for protecting a lens and mirrors of optics (not shown) against contaminants, an eraser 2, a main charger 3, an image carrier in the form of a photoconductive drum 4 which is implemented by a selenium-based photoconductor, a precleaning charger (PCC) 5, a cleaning unit 6, a separating pawl 7, a postcleaning charger (PQC) 8, a photosensor 9 responsive to a potential on the drum 4, a register roller pair 10, a transfer charger 11, a separation charger 12, a transport belt 13, a paddle wheel 14 for feeding a developer having been agitated together with a toner, and a developing sleeve 15 to which the developer is fed by the paddle wheel 14.

Figure 2:
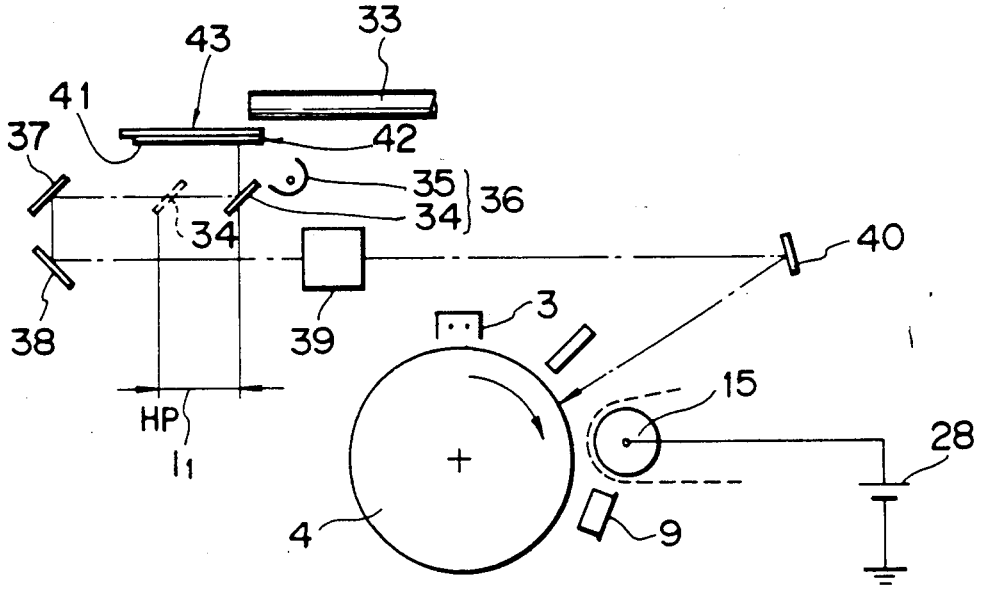
FIG. 2 is a fragmentary section of the copier shown in FIG. 1.

In FIG. 1, the drum 4 is rotated in a direction indicated by an arrow A by a copy command, for example. Simultaneously with the drive of the drum 4, the PCC or discharger 5, eraser 2, transfer charger 11, separation charger 12 and cleaning unit 6 are activated to prevent toner particles and irregular potentials deposited on the drum 4 from reaching the main charger 3 and a developing unit (constituted by the developing sleeve 15). This maintains the surface potential of the drum 4 moved away from a discharging lamp (not shown) zero even after a sheet jam or similar occurence. In this case, the leading edge of an image is positioned on the drum 4 downstream of the position which has moved away from the cleaning unit 6 by a control section. The eraser 2 illuminates an unnecessary area of the drum 4 which has been charged by the main charger 3, so that an image frame matching a paper sheet or an image to be projected is formed on the drum 4. As the drum 4 reaches a predetermined position, imagewise light from the optics is focused on the drum 4 to form a latent image in the image frame. The developing unit develops the latent image to form a toner image, and then the drum 4 is discharged by a pretransfer discharging lamp and a pretransfer discharger (not shown). A paper sheet fed from a paper feed section (not shown) is held in a halt by the register roller pair 10. As soon as the leading edge of the toner image coincides with the leading edge of the paper sheet under the control of the control section, the register roller pair 10 drives the paper sheet again, resulting in the toner image being transferred to the paper sheet. At this instance, since the surface of the drum 4 is extremely smooth and, therefore, the paper sheet is held in tight contact with the drum 4, the separation charger 12 lowers the potential of the paper sheet to reduce the adhering force acting between the drum 4 and the paper sheet. Subsequently, the paper sheet is separated from the drum 4 by the separating pawl 7. The paper sheet separated from the drum 4 is transported by the belt 13 to a fixing station (not shown). As shown in FIG. 2, when the latent image on the drum 4 is developed by the developing unit, a potential may be applied to the developing unit to increase or decrease image density as desired.

Figure 8:
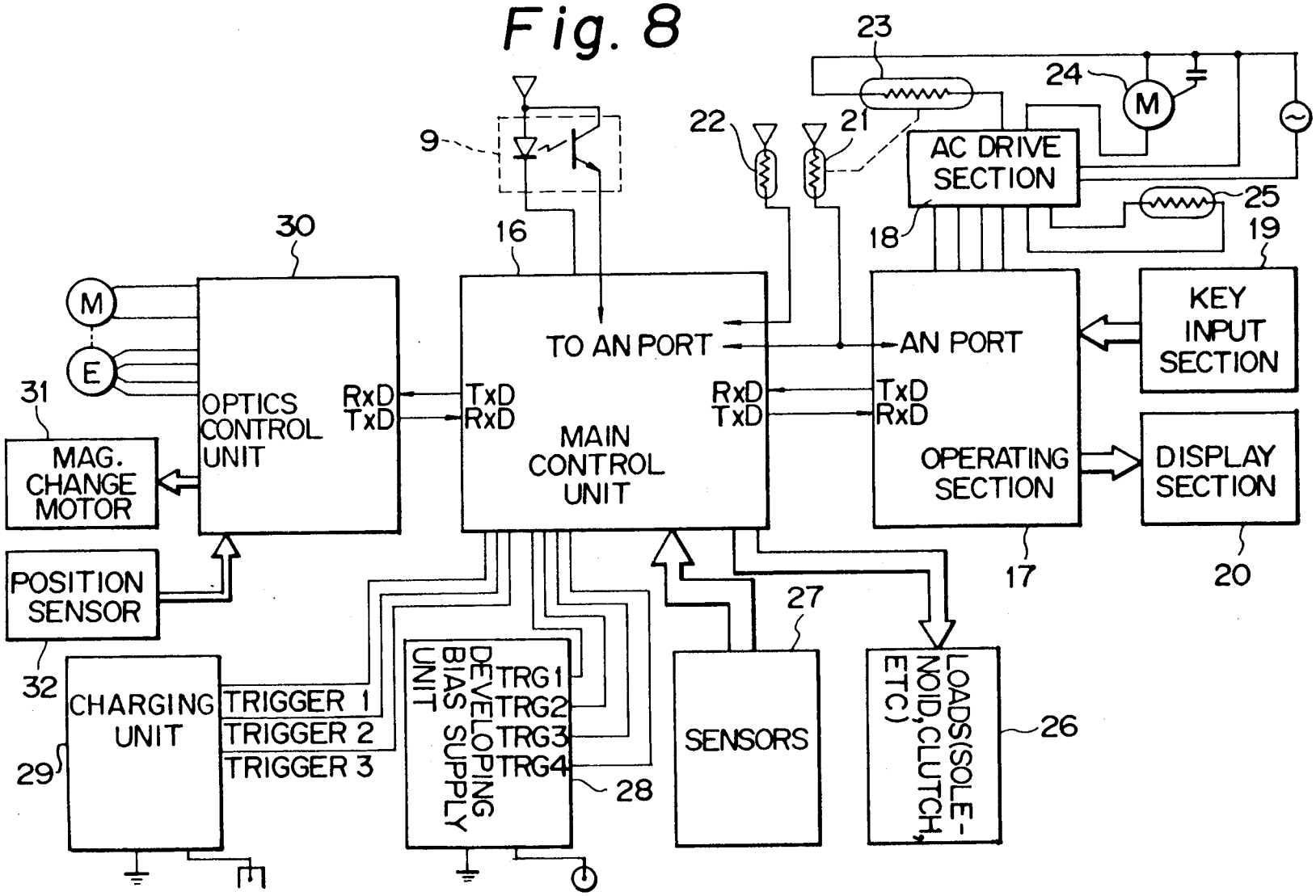
FIG. 8 is a schematic block diagram of a control system for implementing a method of the present invention.

Referring to FIG. 8, a specific construction of a control system is shown in a schematic block diagram. As shown, the control system has a main control unit 16, an operating section 17, an AC driving section 18, a key inputting section 19, a display section 20, a fixation thermistor 21, a drum thermistor 22, a heater 23, a main motor 24, a lamp 25, loads 26 such as solenoids and clutches, sensors 27, a bias supply unit for development 28, a charging unit 29, an optics control unit 30, a motor 31 for magnification change, and a position sensor 32. The photosensor 9 is connected to the main control unit 16.

Figure 3:
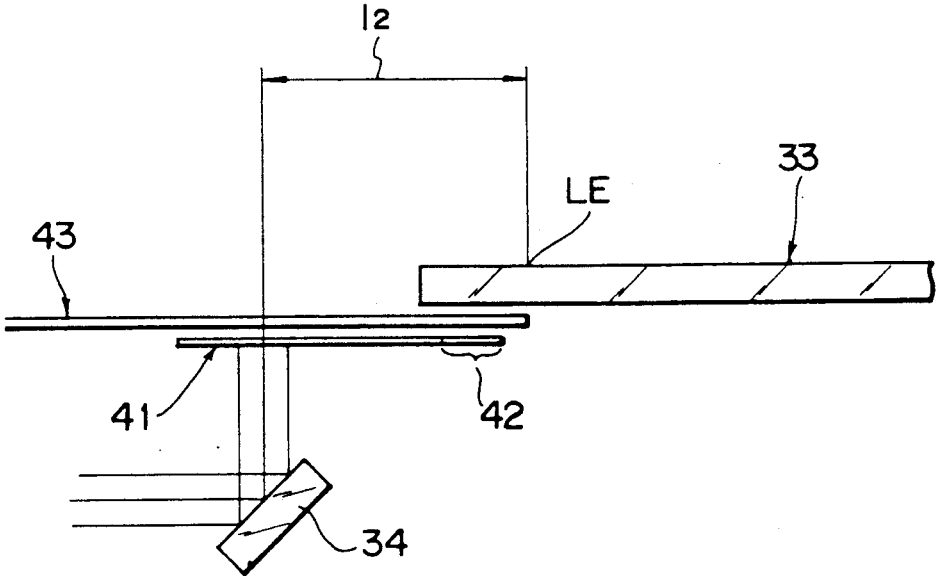
FIG. 3 is an enlarged section of a white reference pattern and its neighborhood.

FIGS. 2 and 3 show a specific arrangement of a focusing system. In the figures, when the drum 4 is rotated to a predetermined position by a copy command, for example, a document laid on the glass platen 33 is scanned by a first scanner 36 on which a first mirror 34 and an illuminating unit (lamp) 35 are mounted. A reflection from the document is steered by the first mirror 34, a second mirror 37, a third mirror 38, a lens 39 and a fourth mirror 40 to the drum 4 and focused thereon. The reference numerals 41 and 42 designate a black pattern and a white reference pattern, respectively. Label $l_1$ is a distance as measured from a home position HP (position of the first mirror 34 indicated by a phantom line).

A reference amount of illumination or exposure is determined as follows.

As shown in FIG. 3, the white reference pattern 42 (0.1 in terms of document density OD) is provided on a bracket 43 at a distance of about 10 millimeters as measured from the leading edge LE side. Also provided on the bracket 43 is the black pattern (OD=1.8) for determining the density and supply of toner while an ordinary copying operation is under way. Since the pattern 41 is located at a different optical length from the document surface, it substantially differs from one machine to another.

Figure 34A:
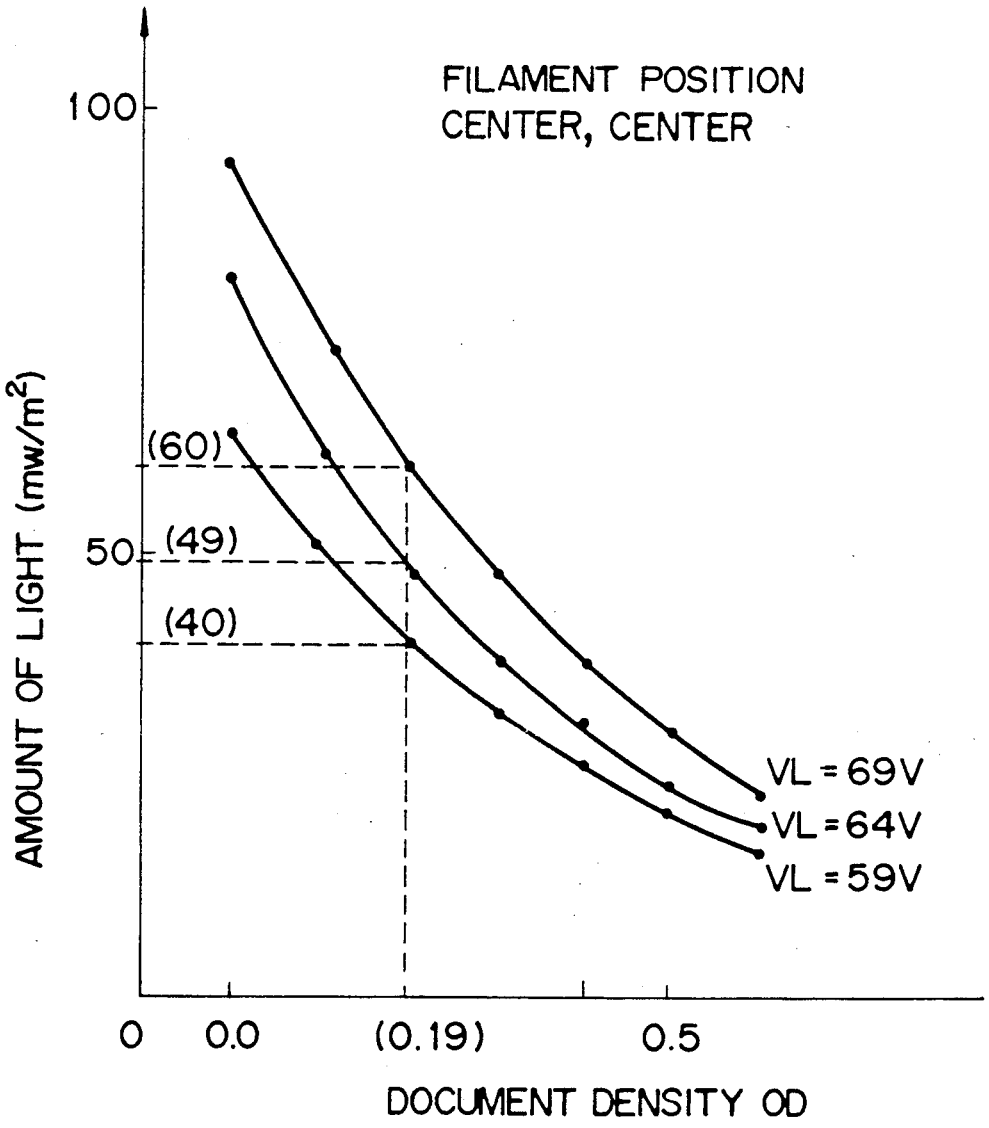
FIGS. 34A to 34C are graphs showing a relationship between the amount of light and the density with respect to different positions of a filament.
Figure 34B:
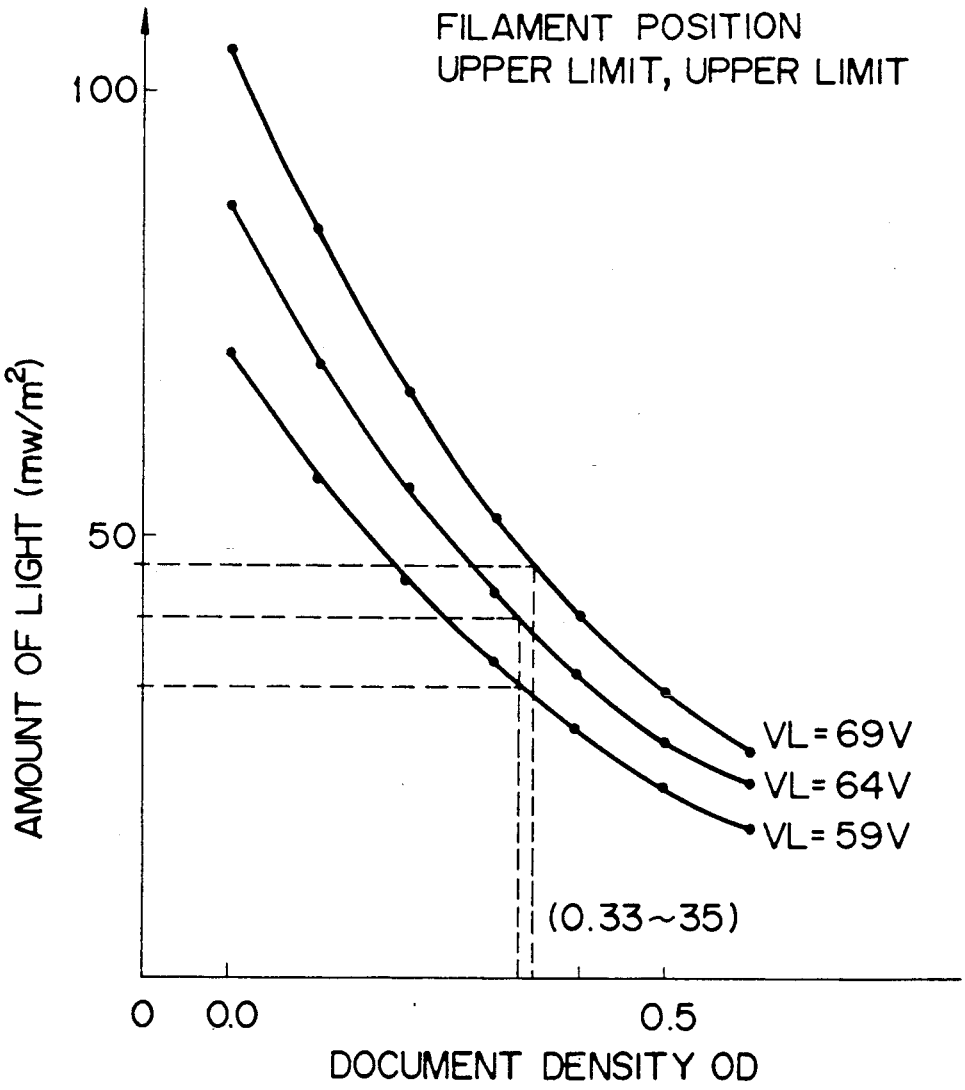
Figure 34C:
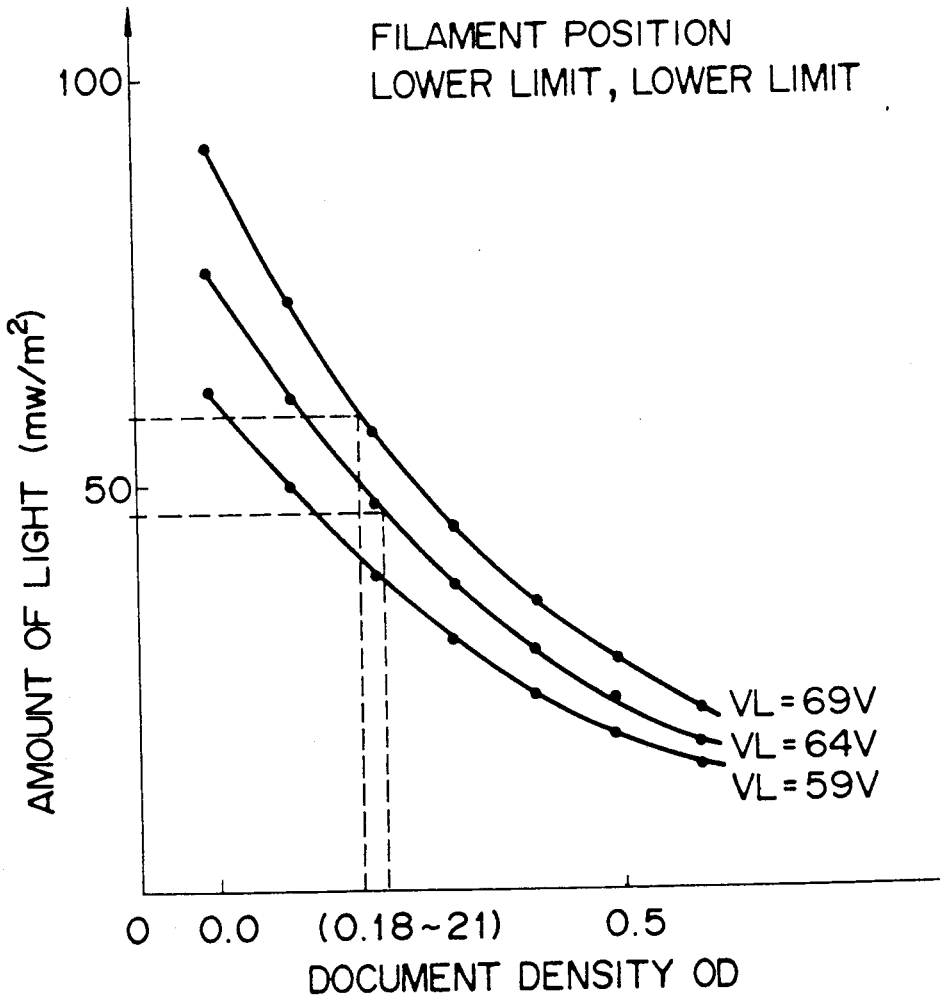

FIGS. 34A to 34C are graphs showing a relationship between the density of the white reference pattern image and the amount of light which was determined by changing the position of a filament and with respect to different potentials VL of the reference pattern image. The curves of the figures prove that the image of the white reference pattern having a density OD of 0.1 undergoes a change in density from 0.18 to 0.35 in terms of document density. Specifically, the amount of exposure as measured on the surface of the drum 4 varies noticeably despite the combination of a constant amount of light (constant voltage of the lamp 35) and the white reference pattern 42. Hence, it is necessary to set the reference value (initial reference data) machine by machine. A difference in the amount of light between machines can be compensated for by correcting the bias voltage for development machine by machine. It is to be noted that the density OD remains constant in individual machines. In FIG. 3, $l_2$ indicates the distance of approach run of the first scanner 36.

Figure 4:
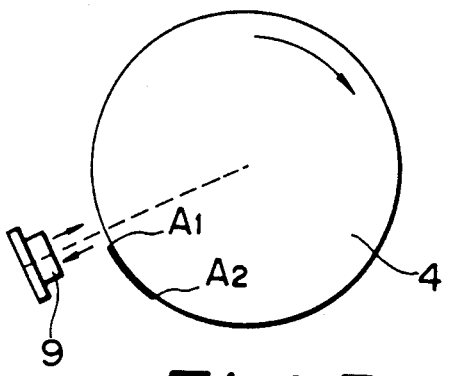
FIG. 4 is a front view showing a relationship between a photosensor and a photoconductive element or image carrier.
Figure 5:
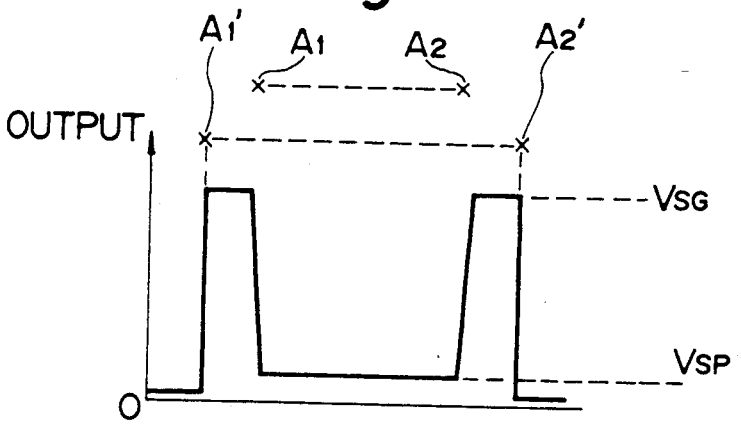
FIG. 5 is a graph showing data read by the photosensor.
Figure 6:
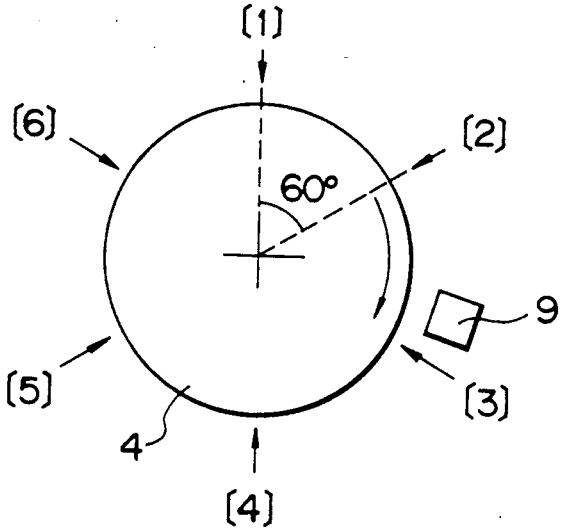
FIG. 6 is a diagram showing sensing positions which are defined on a photoconductive element in the form of a drum.

Referring to FIGS. 5 and 6, an exemplary system for sensing the potential and density is shown. Imagewise light is focused by the focusing system on the drum 4 having been charged by the main charger 3, whereby an electrostatic latent image is formed on the drum 4. The photosensor 9 made up of a light emitting element and a light-sensitive element photoelectrically transforms a reflection from the drum 4 and delivers an output thereof to the main control unit 16. When an image density is to be sensed, the developing unit develops the latent image on the drum 4. Then, the photosensor 9 senses the density of the resulting toner image pattern and feeds to the main control unit 16 a signal which is representative of the sensed potential. In response, the main control unit 16 performs toner density control, toner end detection, etc. In this manner, the photosensor 9 reads not only the pattern on the drum 4 but also the portions of the drum 4 adjacent to the opposite ends $A_1$ and $A_2$ of the pattern, as shown in FIG. 4. Such portions of the drum 4 are labled $A'_1$ and $A'_2$ in FIG. 5 which shows the data read out by the photosensor 9. As shown in FIG. 5, when the ratio of a pattern output VSP to a background output VSG is large, it may be determined that the toner density is low (a black toner reflects hardly any light). The toner supply control and toner-end detection are executed on the basis of the outputs VSG and VSP.

The drum thermistor 22 and fixation thermistor 21 shown in FIG. 8 serve to detect the suspension of operation of the apparatus. When the power switch of the apparatus is turned on, the outputs of the thermistors 21 and 22 are read via an AN port.

Generally, when the power switch is turned off after the warm-up of a fixing roller, the temperature of the fixing roller is sequentially lowered toward room temperature along a curve which is expressed as:

$$TF = A(-e^{-\frac{t}{B}}) \quad (1)$$

where A and B are the constants particular to a machine and t is the time.

Assuming that the temperatures sensed by the thermistors 21 and 22 are TF and TD, respectively, a difference ΔT between TF and TD is produced by:

$$\Delta T = TF - TD \quad (2)$$

In the equation (2), the temperature TD substantially equals room temperature if the operation of the apparatus is suspended over a long period of time. Hence, the suspension time, i.e., the duration of deactivation of the drum 4 can be estimated on the basis of the level of at least one of ΔT (with TD being assumed to be nearly equal to TD) and TF. Since the sensitivity of the drum 4 is susceptible to the duration of deactivation as stated previously, it is possible to correct the reference voltage for development efficiently and, yet, accurately by determining the suspension time on the basis of ΔT or TF. To further promote accurate detection of a suspension time, ΔT and TF may be replaced with a timer which is backed up. As stated above, the illustrative embodiment detects a suspension of the apparatus before the contamination of background and, when ΔT and TF do not satisfy the above condition, does not perform background detection (i.e. a detection start flag is not set).

A reference will be made to FIGS. 2 to 7 for describing how the illustrative embodiment checks the background for contamination.

(1) First, reference values VSGS and BSST are set. The reference value VSGS is the mean value of reflection outputs (VSG) associated with the background of the drum 4 and read by the photosensor 9 with the drum 4 being rotated. The reference value VSST is the reflection output associated with the white reference pattern 42 read with the drum 4 being rotated. A bias output VBS is another reference value used to cope with the amount of exposure on the drum surface which differs from one machine to another. Specifically, considering the fact that the amount of exposure as measured on the drum surface depends on the machine even if the white reference pattern 42, for example, is projected onto the drum 4 by a constant lamp voltage, the bias output is variably controlled to memorize a reference white pattern output VSST which is equal to or greater than 3.0 and equal to or smaller than VSGS. This setting is carried out in a factory, for example. In detail, after the image adjustment of the machine or after forming, for example, the background of the drum 4 and the white reference pattern 42 are illuminated as shown in FIG. 2, and then the resulting latent image is developed by a desired bias output VBS such as 240 volts to 300 volts. The output of the photosensor 9 representative of the densities of the developed pattern are stored in a non-volatile memory (RAM) as the reference values VSGS and VSST. Such setting of reference values involve restrictions, as follows. While VSG is selected to be 4.0±0.2 volts, {VSGS|3.6 volts≦VSGS} is set up because VSGS is generally not equal to VSG. Further, since small VSST narrows the range of an equation which will be described, VBS is varied until {VSST 3.0≦VSST≦VSGS} holds as stated previously. More specifically, after VSST has been read, VBS is varied until VSGS<3.6 volts and 3.0 volts≦VSST≦VSGS hold and the resulting value of VBS is memorized also. However, the restriction associated with VSST depends on the bias output step. The optical path length (magnification), lamp voltage and other various image forming conditions are also stored. It is to be noted that while the repetitive correction associated with drum suspension time is added to the bias output VBS, the illustrative embodiment treats VBS by excluding the repetitive correction.

The photosensor 9 reads a reflection from the surface of the drum 4, as described in detail in relation to the potential sensing and density sensing system. In the illustrative embodiment, the influence of eccentricity of the drum 4 and difference in reflectance on the output of the photosensor 9 is reduced by causing it to sense the reflection at a plurality of equally spaced locations along the circumference of the drum 4 and averaging the resulting outputs. Assume that the drum 4 is equally segmented into six parts by each 60 degrees along the circumference thereof, as shown in FIG. 6. In FIG. 6, the photosensor 9 reads the reflection at four equally spaced positions [1] to [6] of the drum 4 in response to photosensor triggers each matching the angle of 60 degrees and, further, reads it eight consecutive times with respect to each of the six positions [1] to [6] in synchronism with drum pulses. An average value of the values read at each position is outputted. The mean values associated with positions [1] to [6] are outputted as data associated with one rotation of the drum 4. Such a reading operation is repeated six times, and the resulting data are averaged to produce a mean value.

FIG. 7 shows data read by the above-stated, specific procedure. As shown, the data associated with the positions [1] to [6] and resulted from the first rotation of the drum 4 varies from 3.70 to 4.23, the mean value being 3.90. The drum 4 is rotated five more times to produce a mean value $\overline{X}=3.865$ of all of the output data, as shown in FIG. 7. The mean value $\overline{X}$ is memorized as VSGS. By so reading the reflection while the drum 4 is in rotation (with VSG being controlled to 4.0 volts in a suspended state of the machine), it is possible to calculate a correction value (ratio to VSGS) of the reference white pattern output VSST of the photosensor 9 also, in matching relation to the reference background output VSGS. This is successful in enhancing accurate detection. It is to be noted that the timings for effecting the first to sixth reading operations are determined at random.

(2) After the above procedure, values to be compared or comparison values are read. Specifically, when the user turns on the power switch of the apparatus, whether or not the suspension of operation of the apparatus satisfies the previously stated condition is determined. If the condition is satisfied, i.e., when it is decided that the power switch has been turned off more than a predetermined period of time on the basis of the absolute values or differences of the fixing temperature and drum temperature, a reading procedure similar to the procedure executed with the photosensor 9 is effected. This produces a comparison background output (VSG): VSGC and a comparison white pattern output VSCK. These values VSGC and VSCK are also calculated as mean values. A bias output VBS set beforehand on the basis of such data and by using an equation which will be described is corrected by a correction value $+\Delta VB$. The correction value $+\Delta VB$ is selected to be zero for the first reading operation.

(3) The procedure (2) described above is followed by a sequence of steps for setting a correction value. This sequence is effected during the second and successive reading operations. A sum of the bias output VBS and the correction value $+\Delta VB$ is the bias output. The correction value $+\Delta VB$ is determined as follows. By limiting the output of photosensor 9 by the bias output VB or the amount of illumination, for example, the correction value $\Delta VB$ is produced by the following equations. While the contamination of a background is ascribable to an increase in drum potential $V_o$ and a decrease in the amount of illumination (contamination of optics), both of such causes results in an increase in the potential VL of a white area of the drum 4. Assuming that VSG is 4.0 volts (set value), the relationship between the pattern output (VSST, VSCK) of the photosensor 9 and the potential VL is expressed as:

$$\frac{\text{change in white area potential } (\Delta VL)}{\text{change in photosensor pattern Output } (\Delta VSST)} \approx -57 \quad (3)$$

$$(1.0 \text{ volts} < VSST < 2.7 \text{ volts})$$

The ratio of VSGS to VSGC is corrected to VSCK by:

$$VSCK' = VSCK \times \frac{VSGS}{VSGC} \quad (4)$$

Substituting the equation (4) for (3), $$\frac{\Delta VL}{\Delta VSST} = \frac{\Delta XM}{VSCK' - VSST} \approx -57 \quad (5)$$

In the illustrative embodiment, assuming that the bias output step is 30 volts, and that $\Delta VL$ of the equation (5) is 30 volts, then $$|VSST - VSCK'| = 0.526 \text{ volts}$$

$$0.526 \div (5.0 \text{ volts}/255 \text{ bits}) \div 27 \text{ bits}$$

Hence, when (VSST−VSCK') is assumed to be the correction of ($\Delta VB$=) 30 volts which occurs every 27 bits in the control aspect, then the background correction value $\Delta VB$ is produced by:

$$\Delta VB = \text{INT}\left(\frac{VSST - VSCK'}{5.0/255} \div 27\right) \times 30$$

The bias output at the time of reading values to be compared is selected to be $VBS + \Delta VB$ as stated previously for the following reason. Should the bias output VBS be constant, the range wherein $\Delta VL$ can be followed would be limited to $(1.0-3.7)$ volts$\times(-57)=154$ volts (one notch of change in bias voltage is selected to be 60 volts). In contrast, when the bias output is $VBS + \Delta VB$, $\Delta VB$ will be added at each time of background detection. This allows the pattern output to be confined in the range of 1.0 volt to 3.7 volts and thereby satisifies the equation (3) at all times.

As stated above, in the illustrative embodiment, the bias voltage VBS is changed until VSST becomes equal to or higher than 3.0 volts and equal to or lower than VSGS. However, when a VSG error flag or a comparison value error flag is set, the correction data is not added while an ordinary copying operation is under way.

As shown in FIG. 2, the first scanner 34 is usually located at its home position HP which is defined beneath the black pattern 41. Hence, during an ordinary copying operation, a black pattern for controlling the toner density which is one of image forming conditions is formed on the drum 4. In the event when the background is checked for contamination, the first scanner 36 is shifted to a position beneath the white reference pattern 42 to form a latent image of the pattern 42 on the circumference of the drum 4 as a continuous one-round pattern. This latent image is read by the photosensor 9 at equally spaced locations, as stated earlier. The single continuous one-round pattern may be replaced with a plurality of equally spaced segments, if desired. The photosensor 9 reads the background on the drum 4 first and, then, reads the one-round pattern formed thereafter at the same position.

The two patterns stated above are formed while the scanner 36 is moved back and forth. Specifically, the first scanner 36 is reciprocated between the home position, FIG. 2, and the predetermined position beneath the white reference pattern 42. While the scanner 36 is moving forward, a black pattern for toner density control is formed on the drum 4 with the conditions (steps) necessary for pattern formation being executed. On the other hand, the white pattern is formed on the drum 4 by locating the scanner 36 at a position remotest from the home position HP, as stated earlier. These patterns adapted for the control over image forming conditions extend in parallel to the direction of movement (forward) of the scanner 36.

In this manner, the illustrative embodiment uses two different patterns in controlling image forming conditions. The black pattern is read while the scanner is in movement, and the white pattern is read while the scanner is in a halt. This allows a minimum of error to occur when the black and white patterns are read. A single scanner suffices to implement a plurality of patterns for the control over image forming conditions. Although the white pattern is usually susceptible to the eccentricity to the drum 4, for example, the influence of such eccentricity will be reduced if the scanner reads a plurality of small patterns while in a halt. It follows that the output of the photosensor 9 is free from noticeable errors and, therefore, promotes accurate correction of toner density (black pattern) and background output (white pattern) based on sensed values.

Figure 9:
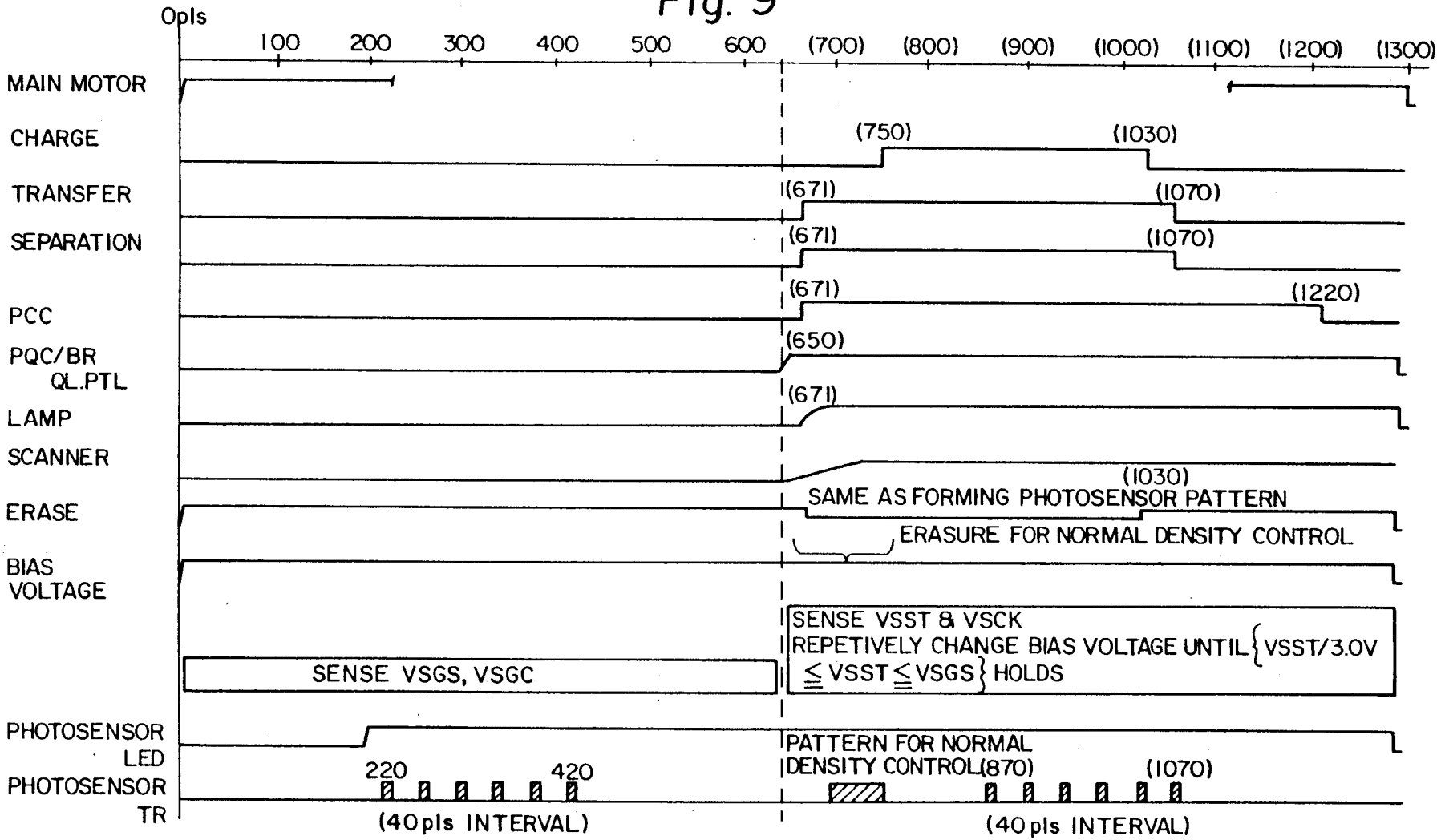
FIG. 9 is a timing chart useful for understanding the operation of the control system.

FIG. 9 is a timing chart demonstrating a specific operation of the illustrative embodiment. As shown, there occur in predetermined clock pulse ranges the turn-on of a main motor, charging, image transfer, paper separation, PCC, PQC/BR, QL, PTL, turn-on of the lamp, scanner movement, erasure, application of bias voltage for development, and turn-on of the photosensor. VSGS and VSGC are detected, and the bias voltage is corrected to make VSST equal to or higher than 3.0 volts and equal to or lower than VSGS.

The contamination of a background is ascribable to an increase in the surface potential of the photoconductive element (drum potential) and a decrease in the amount of exposure due to the contamination of optics, as stated previously. The decrease in the amount of exposure translates into an increase in the potential VL of the white reference pattern.

Figure 30:
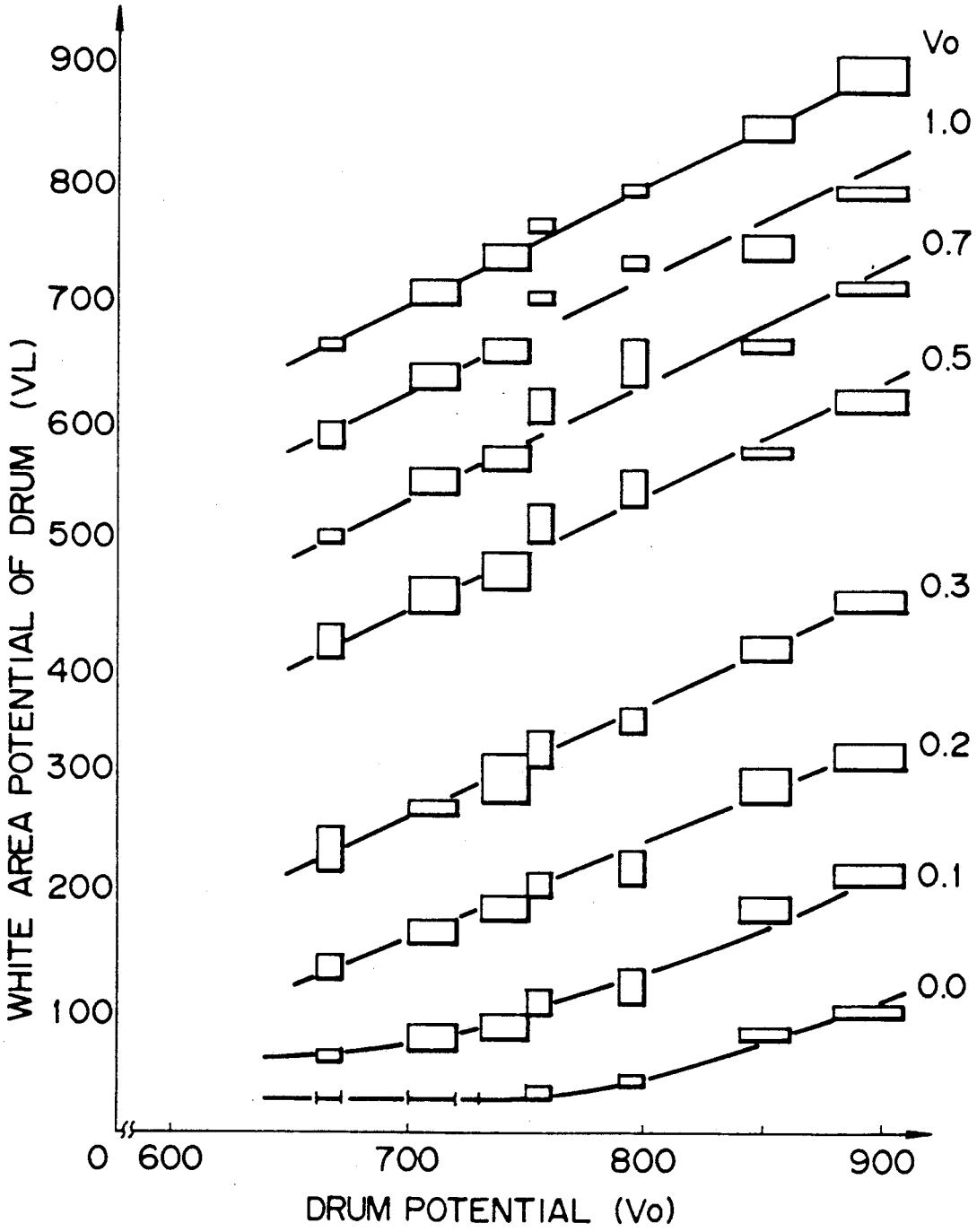
FIG. 30 is a graph showing a relationship between the drum potential $V_o$ and the potential VL of a white area of the drum.
Figure 31:
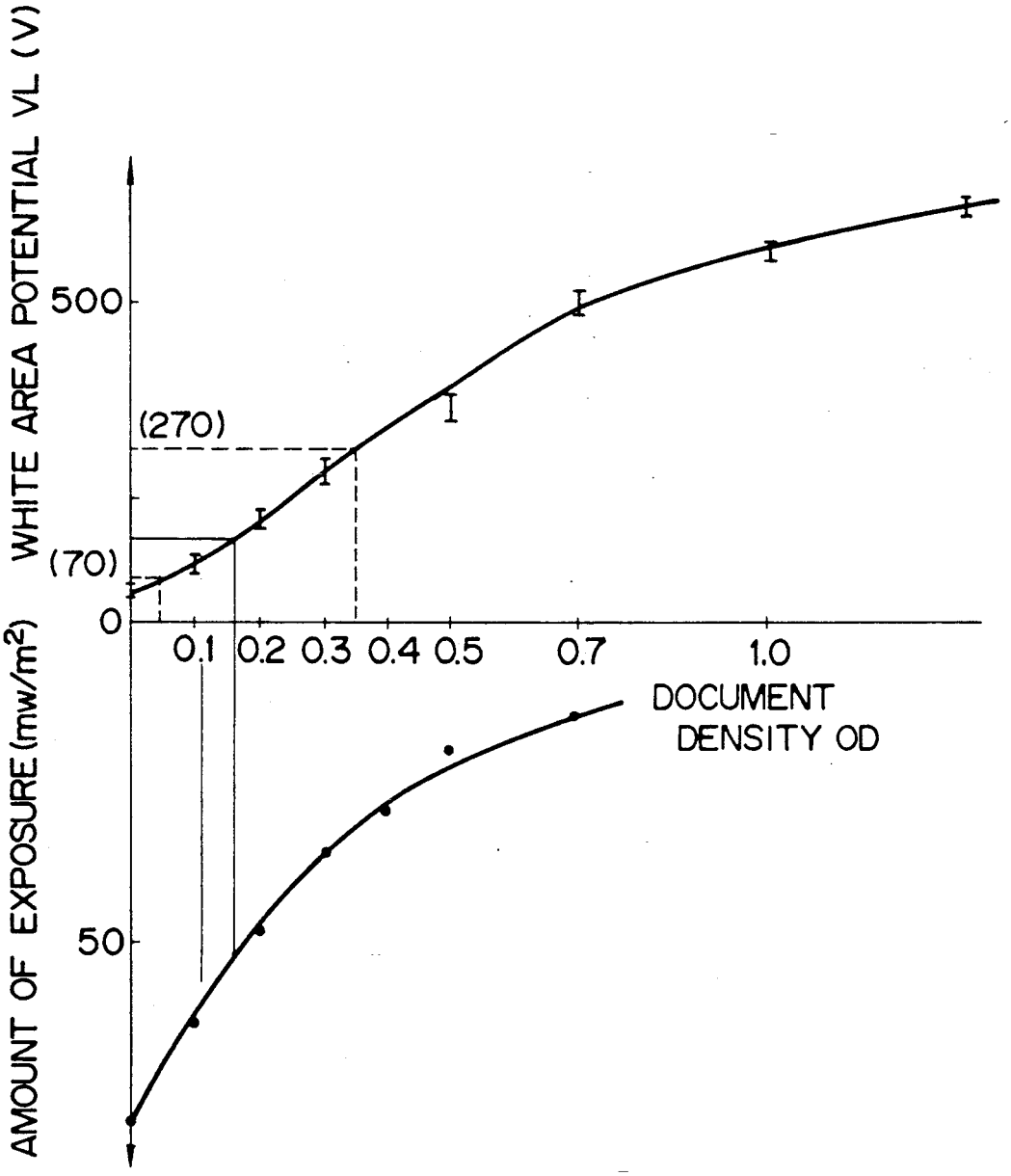
FIG. 31 is a graph representative of a relationship between the amount of exposure and the potential VL.
Figure 32:
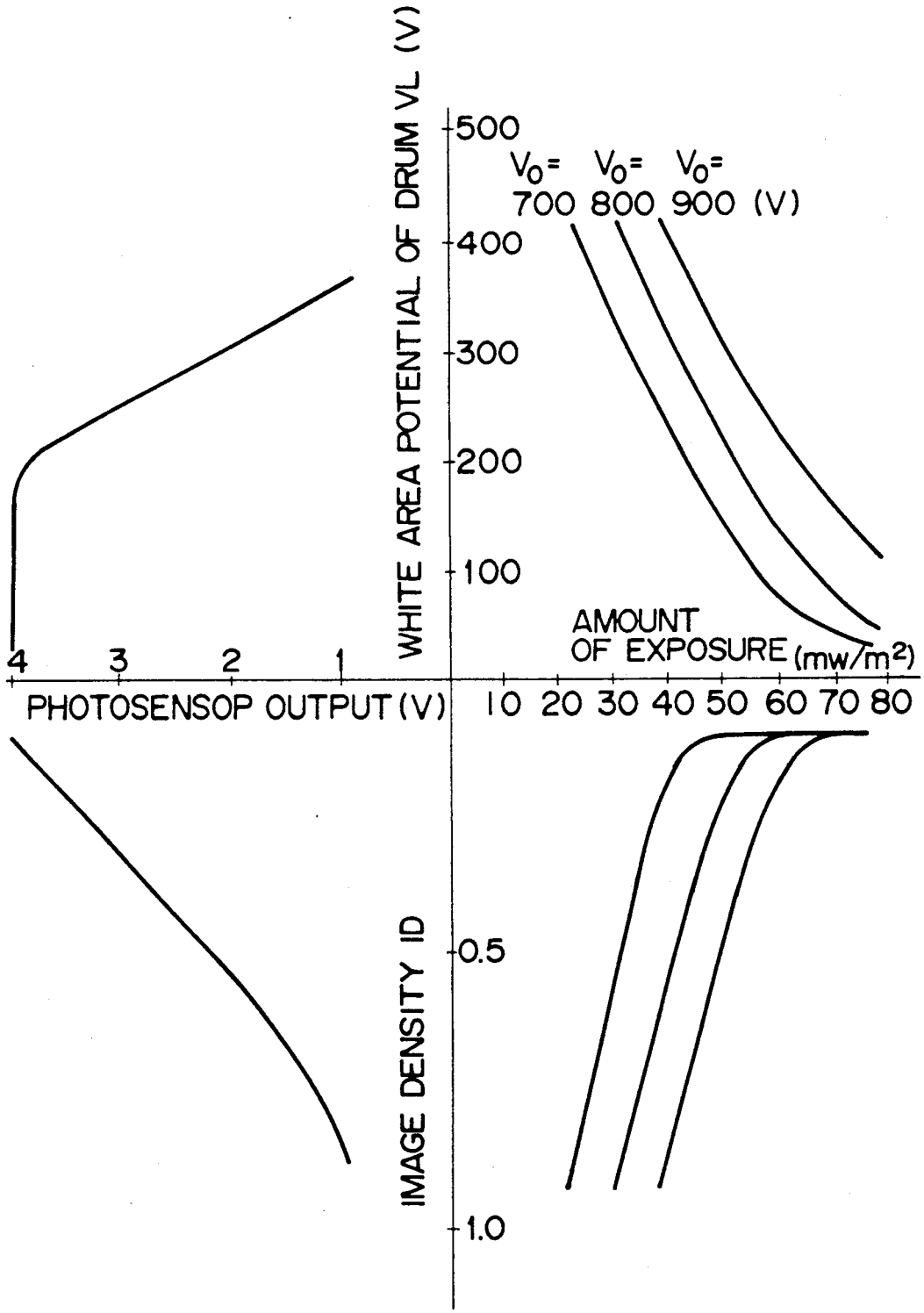
FIG. 32 is a graph showing a relationship between the potential VL and the photosensor output.
Figure 33:
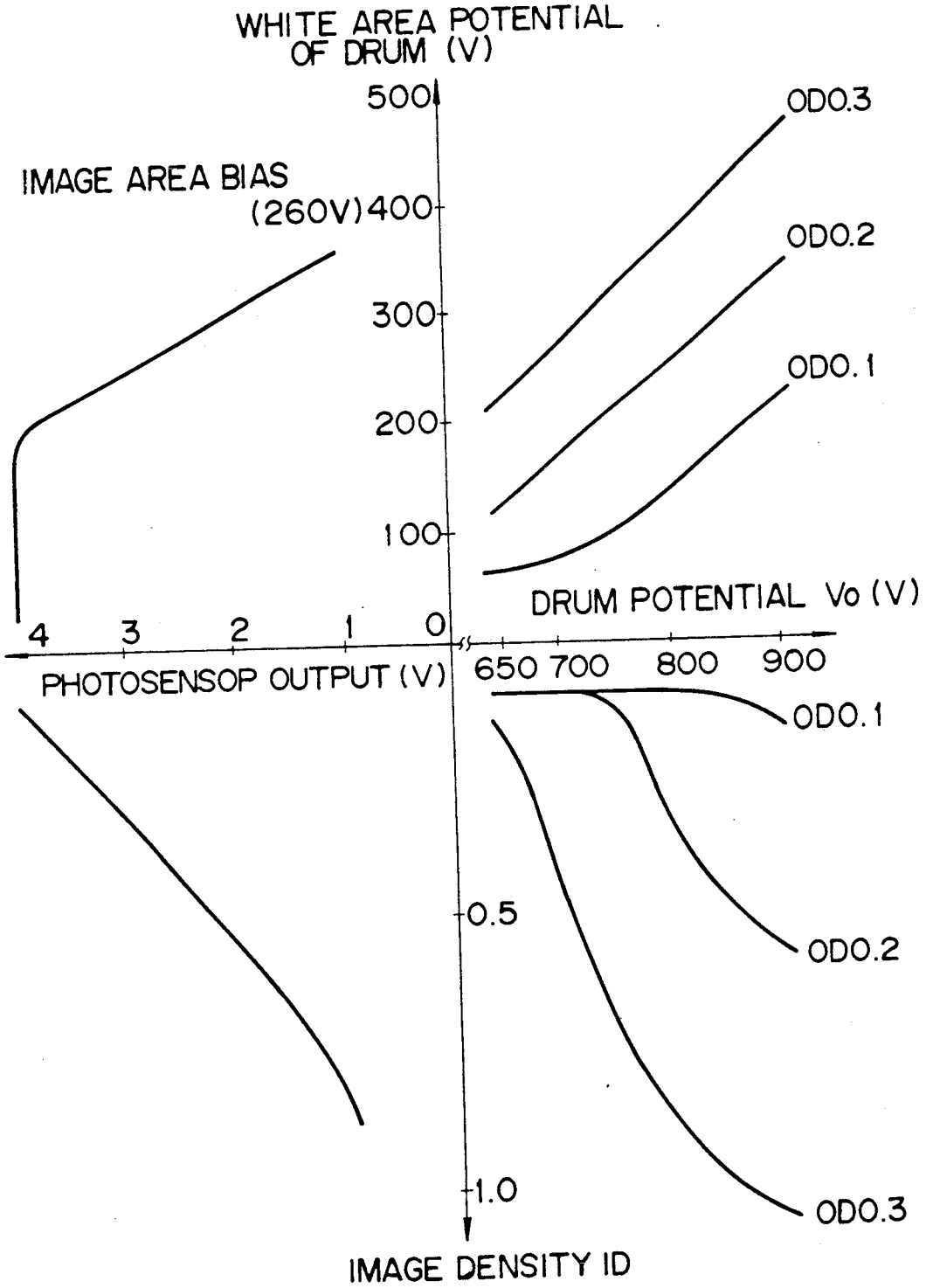
FIG. 33 is a graph showing a relationship among the drum potential $V_o$, the potential VL and the photosensor output.

FIG. 30 is a graph showing a relationship between the drum potential $V_o$ and the potential VL of a white area of the drum. In the graph, the rectangles are the ranges of numerical values over which the measured values were scattered. FIG. 31 shows a relationship between the amount of exposure and the potential VL, and this relationship was obtained with a drum potential $V_o$ of 760 volts, a thermistor temperature of 32° C. to 33° C., and a drum temperature of 25° C. to 27° C. FIG. 32 indicates how the potential VL and the photosensor output are related with respect to the drum potential $V_o$. Further, FIG. 33 indicates a relationship among the drum potential $V_o$, potential VL and photosensor output by using the density as a parameter.

The general operations of the illustrative embodiments for correcting the bias voltage for development will be described hereinafter.

Figure 10:
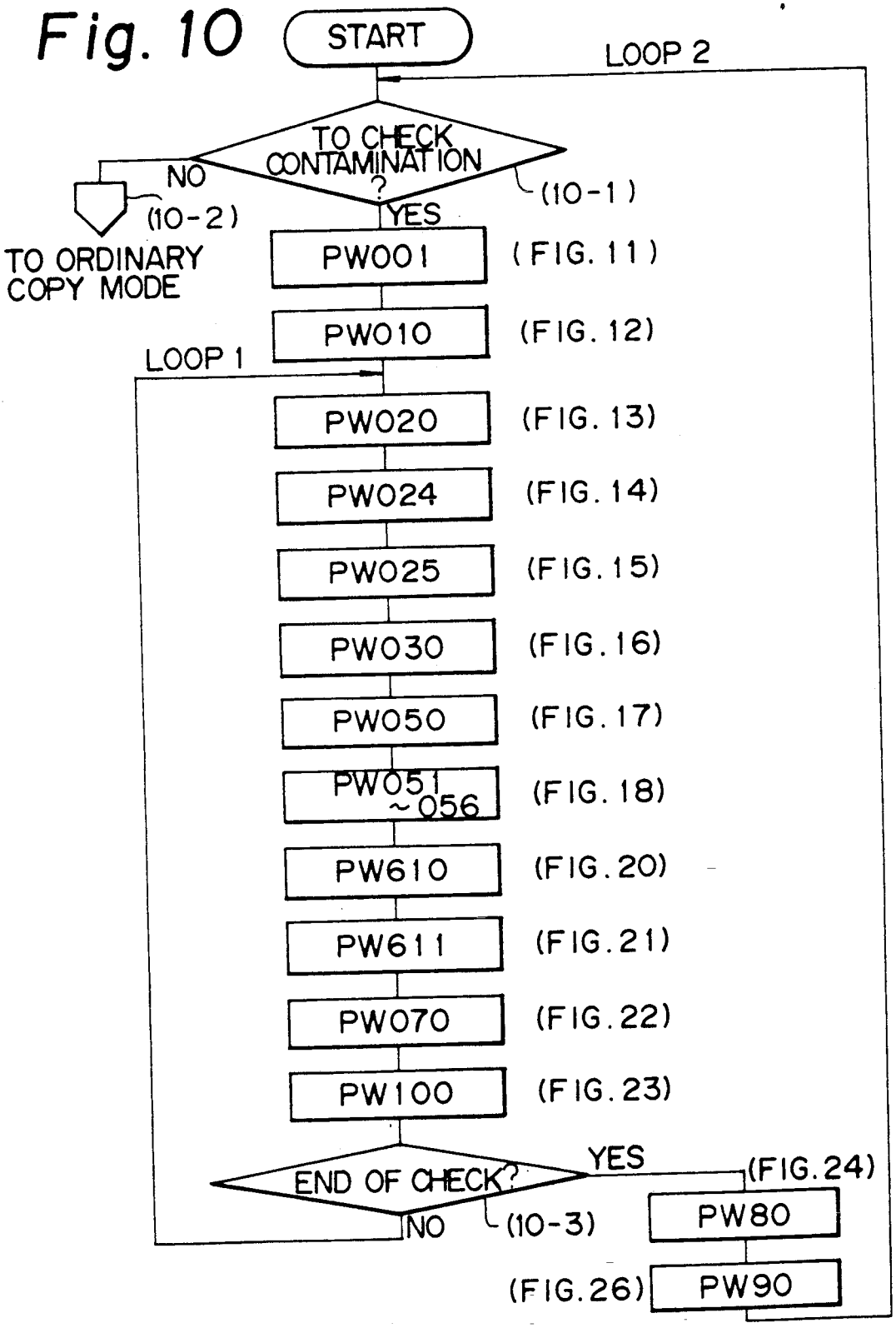
FIG. 10 is a flowchart showing a general sequence for checking a background for contamination.

Referring to FIG. 10, a procedure for checking a background for contamination is outlined. Details of this procedure are shown in FIGS. 11 to 28. The procedure of FIG. 10 begins with a step 10-1 for determining a suspended state of the apparatus on the basis of the equation (2). If the condition associated with the suspension of operation is satisfied, the program advances to a routine PW001; if otherwise, a copying operation is effected in an ordinary copy mode.

Figure 11:
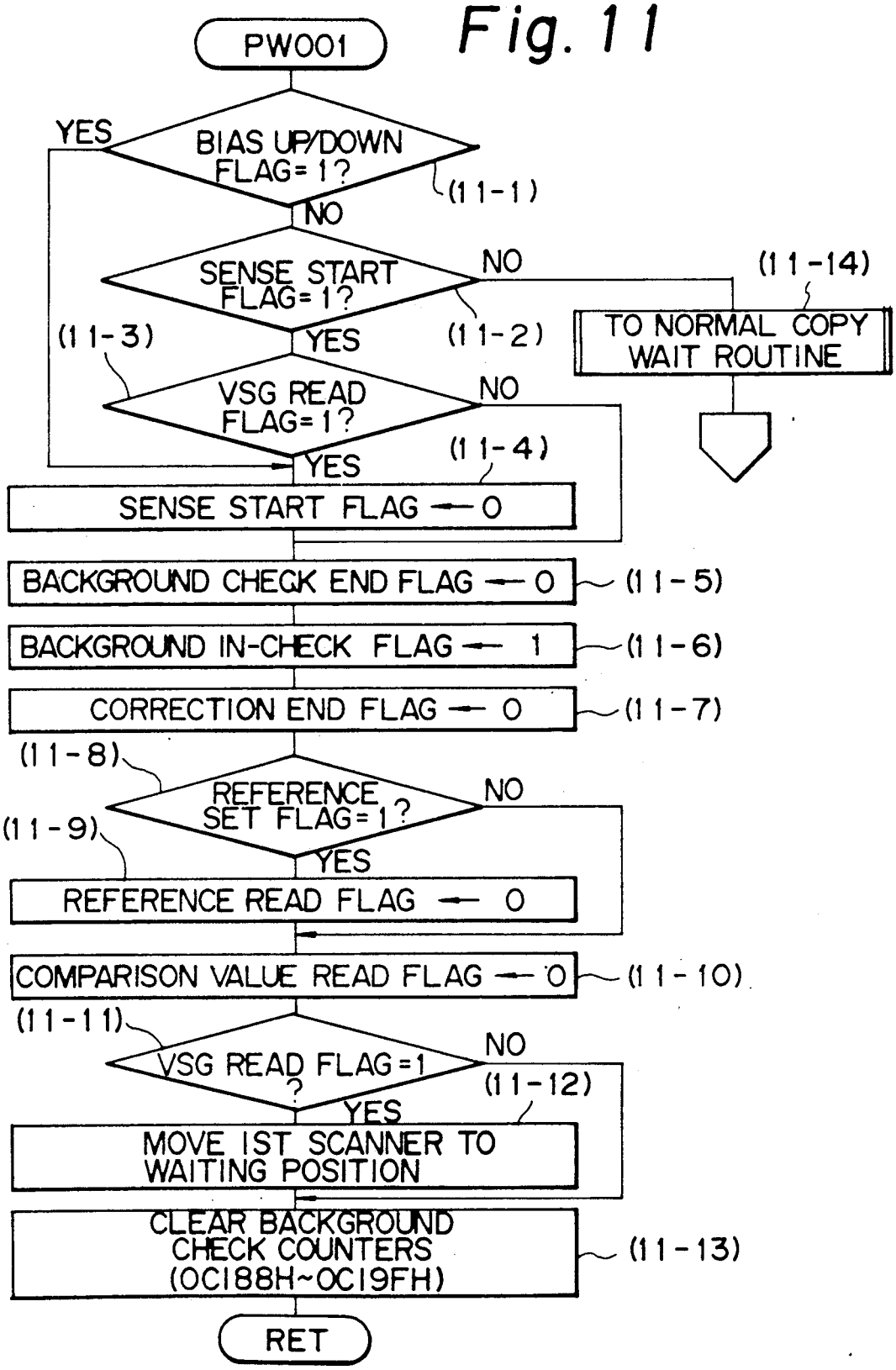
FIGS. 11 to 28 are flowcharts demonstrating the individual procedures of FIG. 10 in detail.

As shown in FIG. 11, in the routine PW001, whether or not a bias up/down flag is set or (logical) ONE or not is determined (step 11-1). If the answer of the step 11-1 is NO, a sense start flag is checked to see if it is ONE (step 11-2). If the answer of the step 11-1 is YES, the operation advances to a step 11-3; if otherwise, the program is transferred to an ordinary copy wait routine via a step 11-14 without the background sensing operation being executed. In the step 11-3, whether or not a VSG (background output) read flag is ONE is determined. If the answer of the step 11-3 is YES, the sense start flag is reset or turned to (logical) ZERO (step 11-4), a background check end flag is turned to ZERO (step 11-5), a background in-check flag is turned to ONE (step 11-6), and a correction end flag is turned to ZERO (step 11-7). If the answer of the step 11-1 is YES, it is directly followed by the step 11-4. If the answer of the step 11-3 is NO, it is directly followed by the step 11-5. In a step 11-8, whether a reference set flag is ONE or not is determined. If the answer of the step 11-8 is YES, a reference read flag is turned to ZERO (step 11-9) while a comparison value read flag is turned to ZERO (step 11-10). At the same time, if the VSG read flag is ONE (step 11-11), the first scanner 36 is moved by 10 millimeters to a stand-by position as shown in FIG. 2 and, during this movement, scans the black pattern for density control to form its pattern on the drum 1 (step 11-12). Counters adapted to check a background for contamination are cleared (step 11-13). By the sequence of steps described above, whether background checking can be executed or not is determined.

Figure 12:
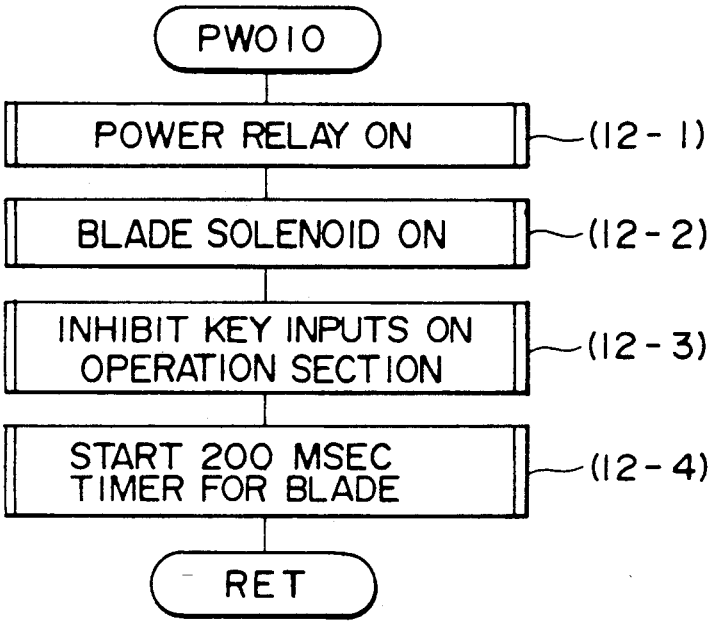

The routine PW001 of FIG. 10 is followed by a routine PW010 which is shown in detail in FIG. 12. The routine PW0101 has a step 12-1 for turning on a power relay, a step 12-2 for energizing a solenoid associated with a blade, a step 12-3 for inhibiting key inputs on the operating section, and a step 12-4 for starting a 200 milliseconds timer adapted for the blade.

Figure 13:
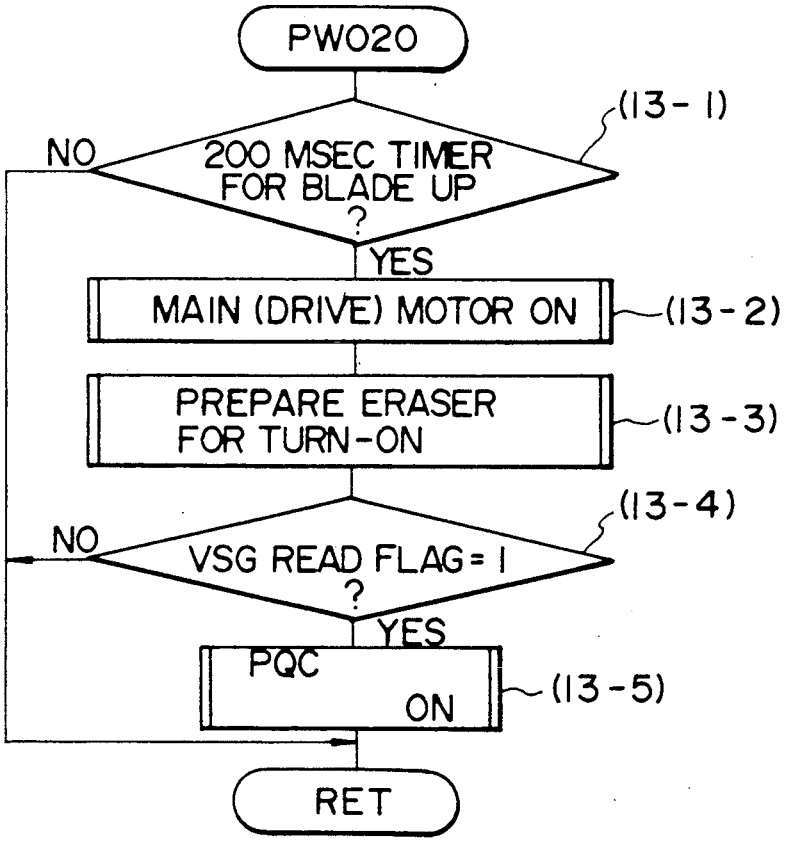

Then, a routine PW020 is executed. As shown in FIG. 13, if the 200 milliseconds timer for the blade is counting up (step 13-1), the main motor 24 is energized (step 13-2) and the erasure is prepared for operation (step 13-3). If the VSG read flag is ONE as determined in a step 13-4, the postcleaning discharger (PQC) is energized (step 13-5).

As stated above, in the routine PW010 shown in FIG. 10, the scanner is shifted to a position below the white reference pattern.

Figure 14:
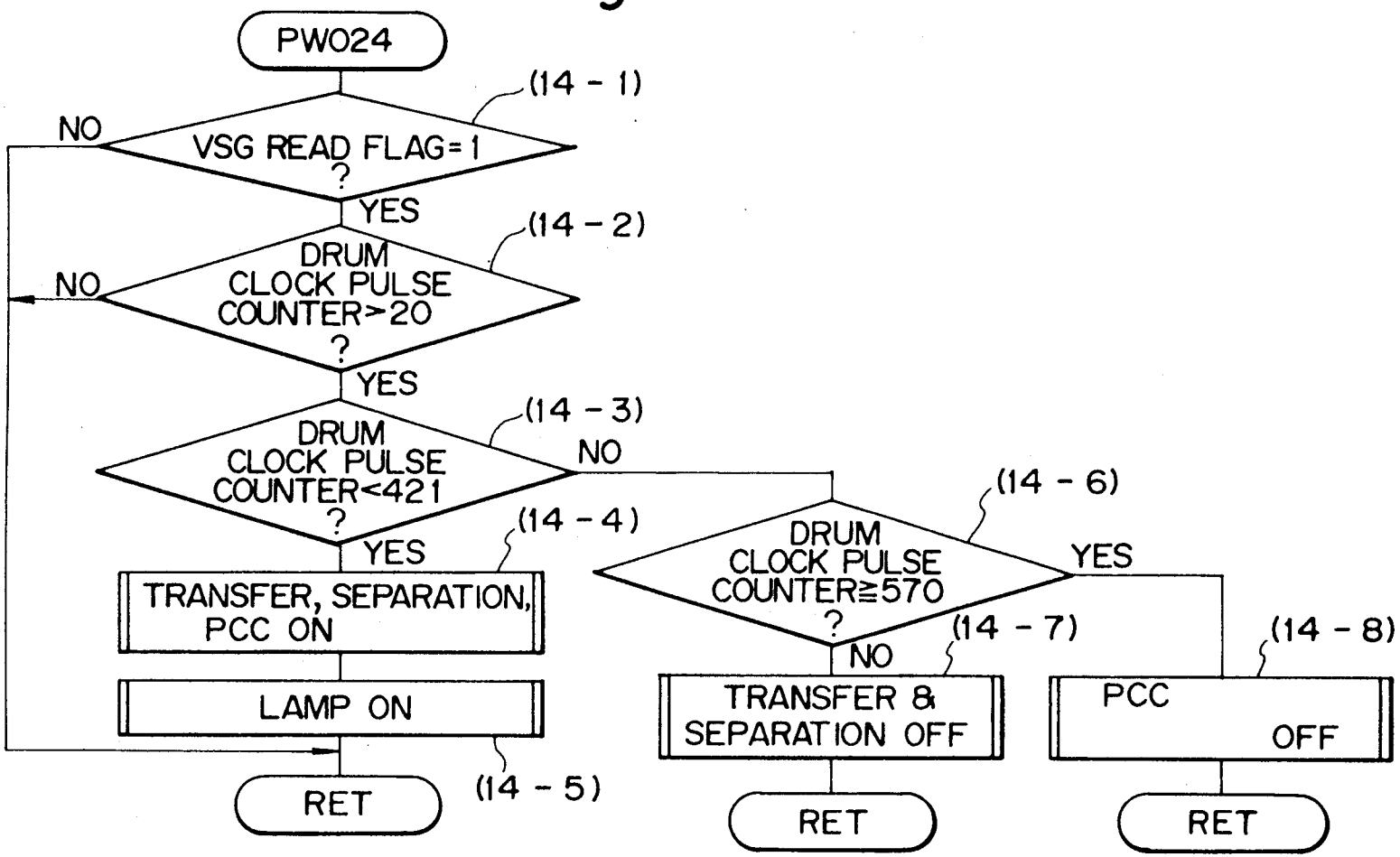
Figure 15:
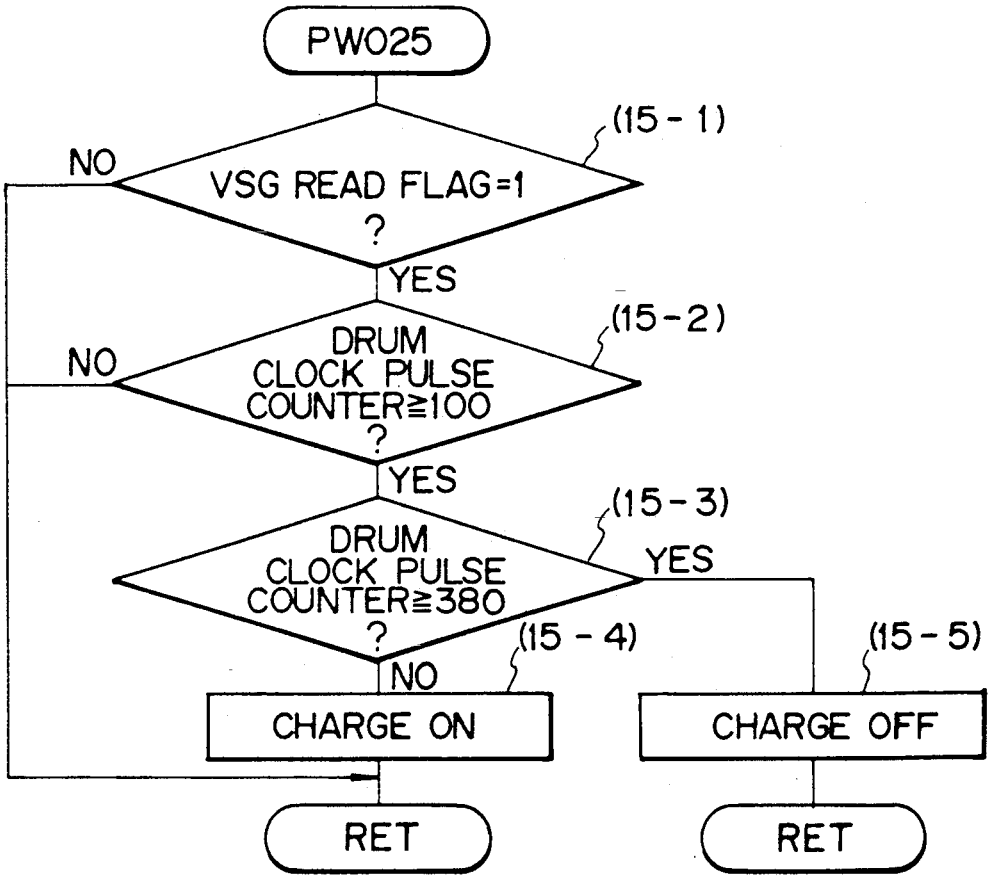

Subsequently, routines PW024 and PW025 shown in FIG. 10 are executed. As shown in FIG. 14, if the VSG read flag is ONE (step 14-1), if a drum clock pulse counter has exceeded 20 (step 14-2), and if it has not exceeded 421 (step 14-3), the transfer charger, separation charger and precleaning charger (PCC) 5 are energized (step 14-4) and the lamp 35 is turned on (step 14-5). If the drum clock pulse counter has exceeded 421 (step 14-3), whether or not the count is greater than 570 is determined (step 14-6). If the answer of the step 14-6 is NO, the image transferring and paper separating operations are stopped (step 14-7); if otherwise, the PCC 5 is turned off (step 14-8). Then, as shown in FIG. 15, if the VSG read is ONE (step 15-1) and if the drum clock pulse counter has exceeded 100 but not 380 (steps 15-2 and 15-3), charging is turned on (15-4). If the drum clock pulse counter has exceeded 380 (step 15-3), the charging operation is stopped (step 15-5). The procedure described with reference to FIGS. 14 and 15 determines the on/off state of the high-tension power source.

Figure 16:
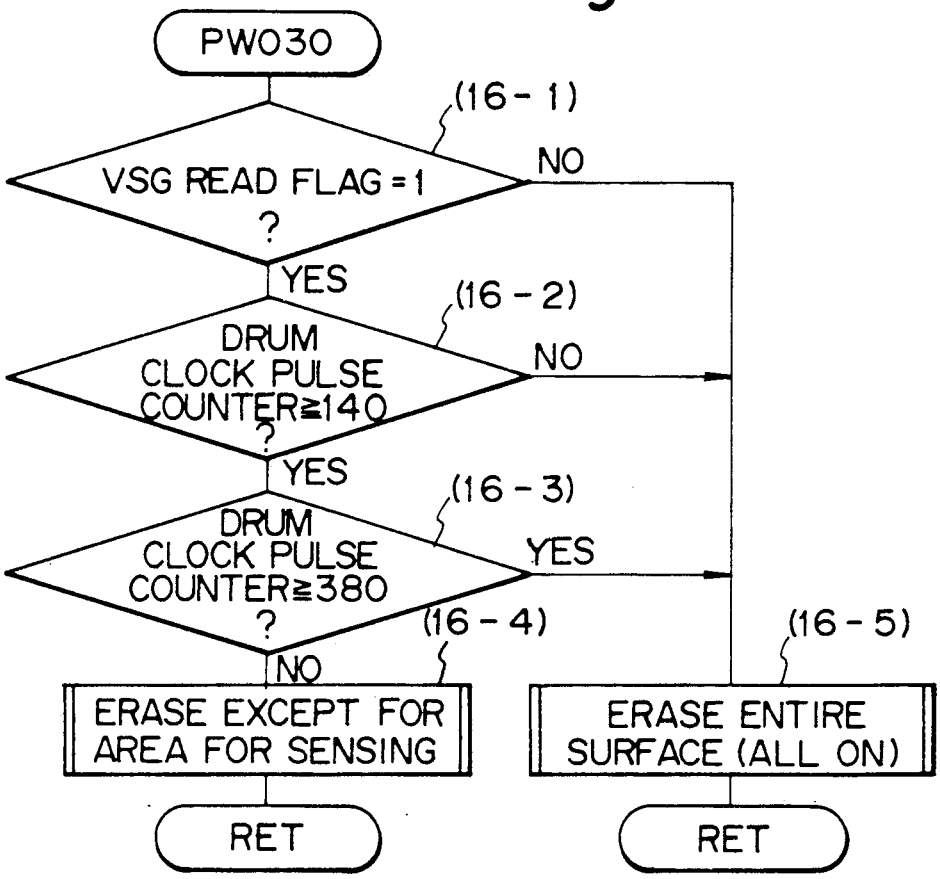
Figure 17:
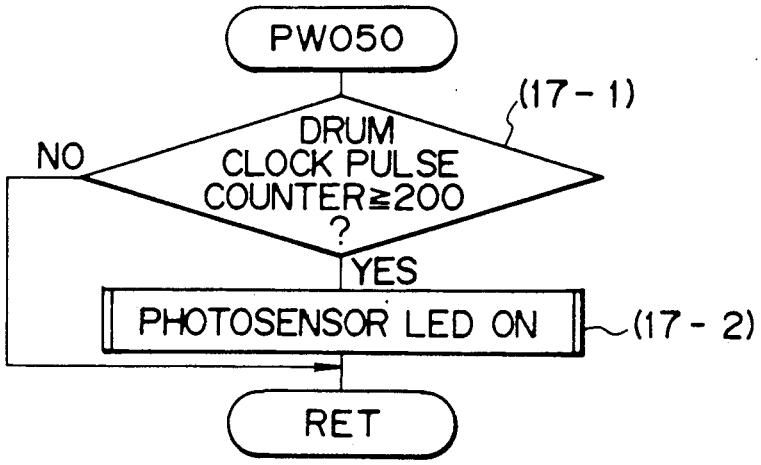

Subsequently, a routine PW030 is executed as shown in detail in FIG. 16. In FIG. 16, if the VSG read flag is ONE (step 16-1) and if the drum clock pulse counter is greater than 20 but smaller than 380 (steps 16-2 and 16-3), the drum 4 is erased except for the area to be read by the photosensor 9 (step 16-4). If the VSG read flag is not ONE or if the drum clock pulse counter is not greater than 20 or greater than 380 (steps 16-1, 16-2 and 16-3), the drum 4 is entirely erased (step 16-5). This completes an erase timing checking procedure.

Figure 18:
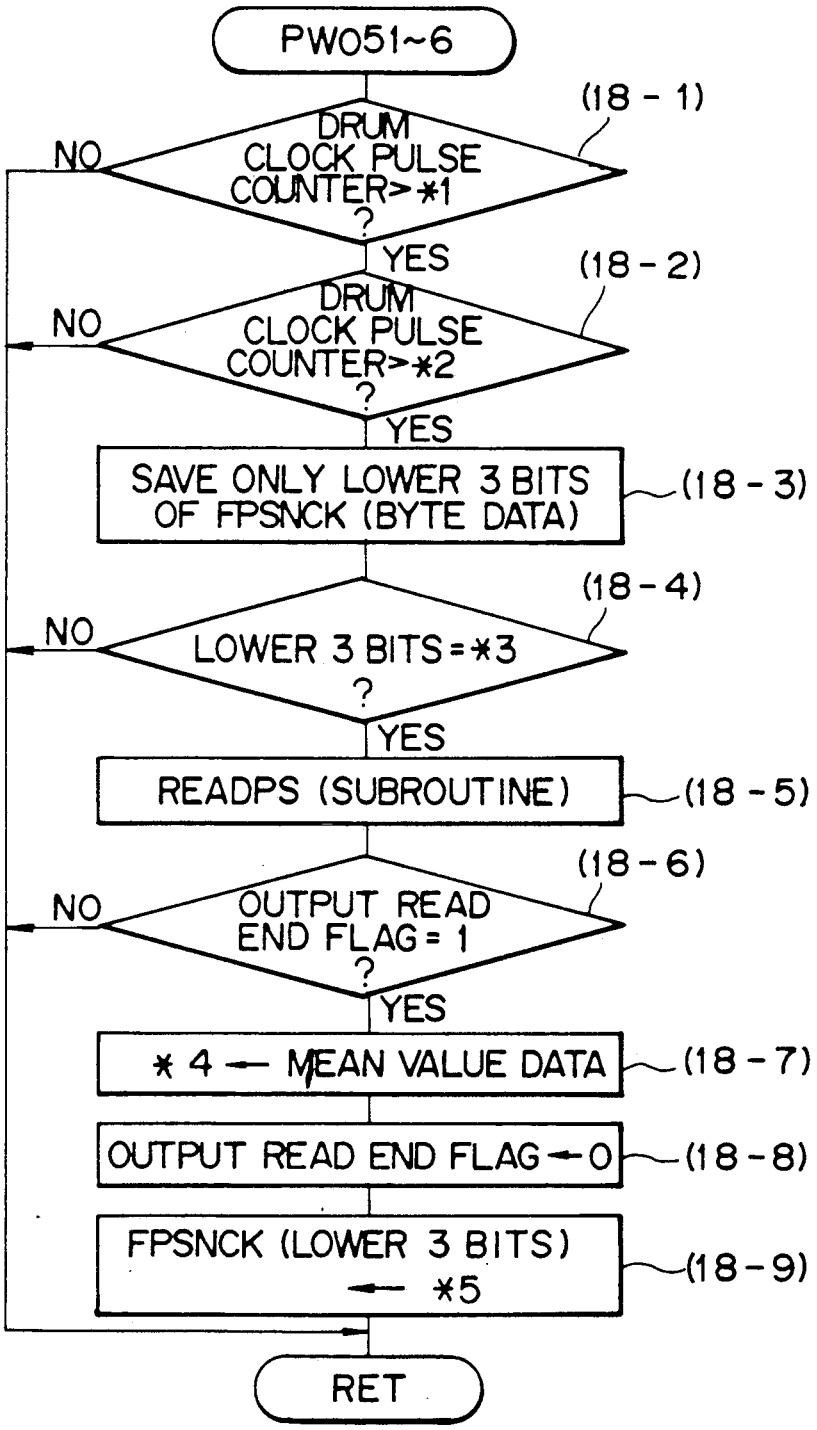

The routine PW030 is followed by a routine PW050. This routine includes output data read timing processing which is shown in FIG. 18. This processing occurs six times at each angular position of the drum 4, and the numerical values indicated by *1 to *5 in FIG. 29 vary each time. Concerning the first processing, if the drum clock pulse counter has exceeded 219 and not exceeded 232 (steps 18-1 and 18-2), only lower three bits of FPSNCK (byte data) are saved (step 18-3). If the lower three bits of data are 00H (step 18-4), a subroutine READPS is executed (18-5). If an output read end flag is ONE (step 18-6), mean value data are written in DPSTL1 (addresses of individual output data) (step 18-7), the output read end flag is turned to ZERO (step 18-8), and FPSNCK (lower three bits) which is the next read flag is changed to 01H.

Figure 19:
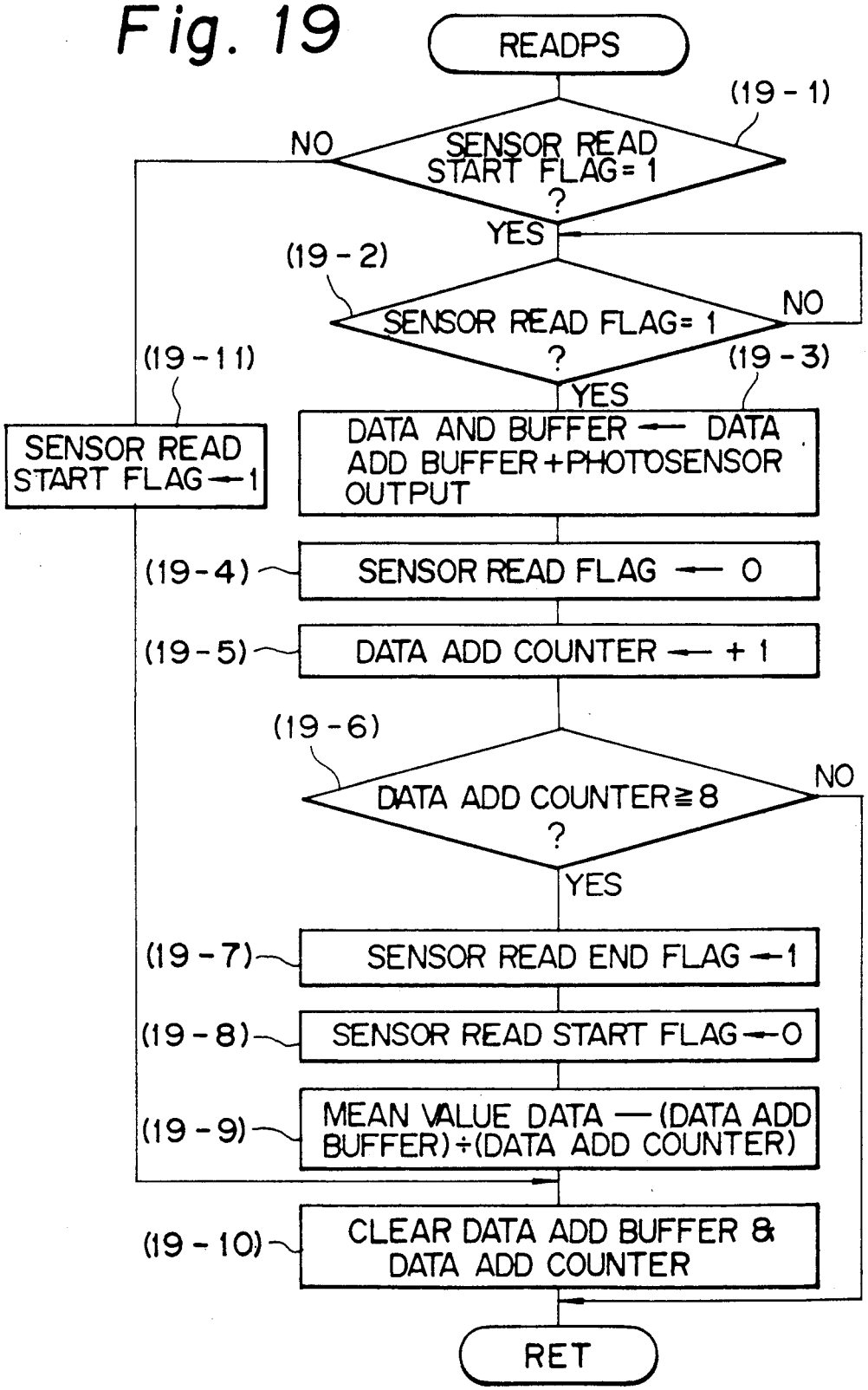

As shown in FIG. 19, in a subroutine READPS, if a photosensor read start flag is ONE (step 19-1) and if a photosensor read flag is ONE (step 19-2), a sun of a data adding buffer and a photosensor output is loaded in the data adding buffer (step 19-3), the photosensor read flag is turned to ZERO (step 19-4), and a data adding counter is incremented by 1. As the data adding counter exceeds 8 (step 19-6), a photosensor read end flag is turned to ONE (step 19-7), the photosensor read start flag is turned to ZERO (step 19-8), a value produced by dividing the data adding buffer by the data adding counter is inputted in the main value data (step 19-9), and the data adding buffer and data adding counter are cleared (step 19-10). This mean value data (19-9) is inputted as the mean value data which is represented by the step 18-7 of FIG. 18. On the other hand, if the photosensor read start flag is not ONE (step 19-1), it is turned to ONE (step 19-11) and the step (19-10) is executed. Further, if the photosensor read flag is not ONE (step 19-2), it is turned to ONE at the leading edge or training edge of the drum clock pulse, for example. In this manner, the processing shown in FIGS. 18 and 19 causes the photosensor 9 to read the drum 4 at equally spaced locations of the latter (every 60 degrees) and repeat such a reading operation six consecutive times.

Figure 20:
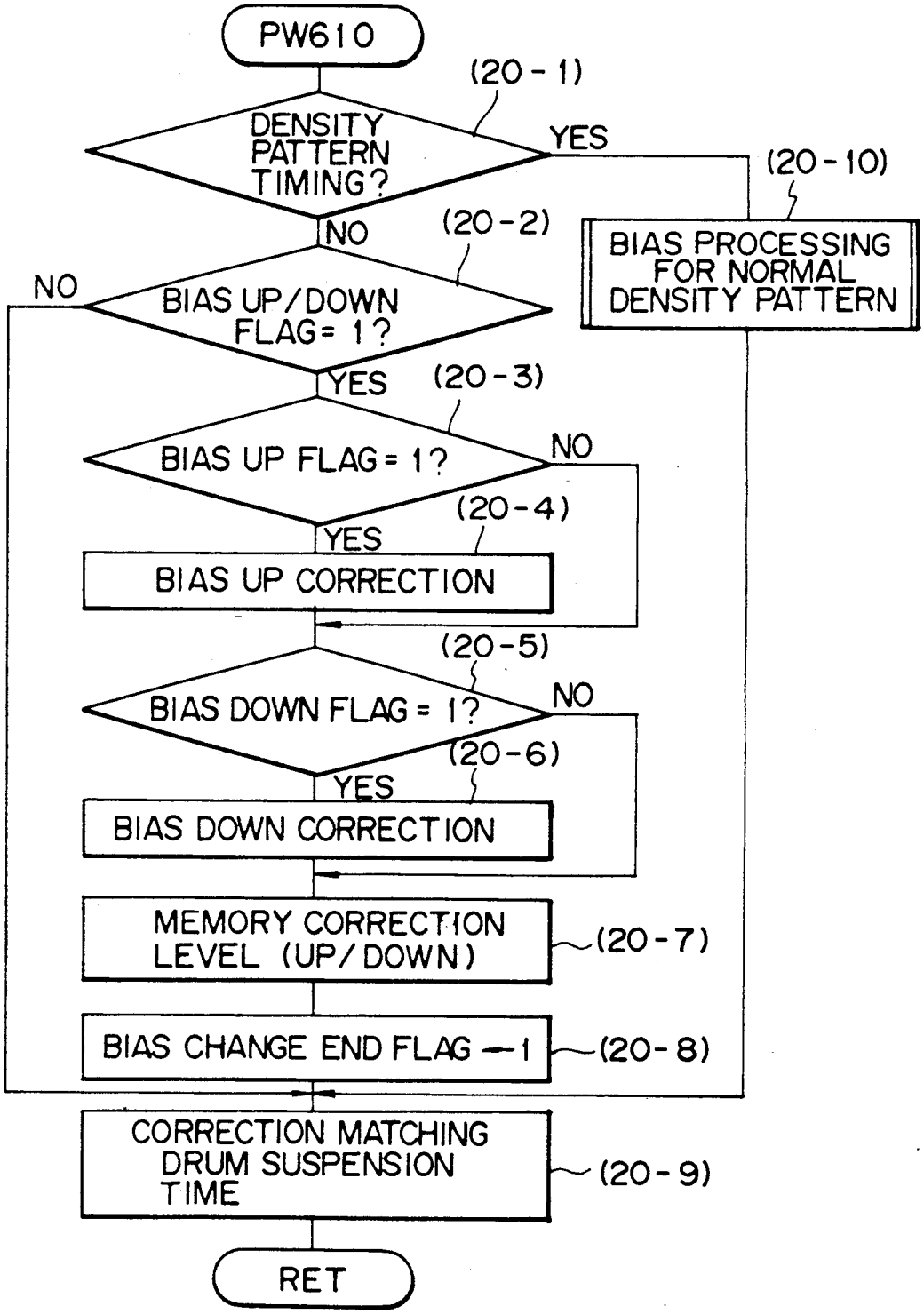

A routine PW610 of FIG. 10 is shown in detail in FIG. 20. As shown, whether or not a timing for forming a toner density pattern has been reached is determined, (step 20-1). If the answer of the step 20-1 is NO, the program advances to a step 20-2. In step 20-2, if the bias up/down flag is ONE (step 20-2), and if a bias up flag is ONE (step 20-3), bias-up correction is executed (step 20-4). If a bias down flag is ONE (step 20-5), bias-down correction is executed (step 20-6). The corrected level (up or down) is memorized (step 20-7). Then, a bias change end flag is turned to ONE (step 20-8), and then correction is executed in matching relation to the period of time during which the operation of the drum 4 has suspensed (step 20-9). On the other hand, if the answer of the step 20-1 is YES, bias processing for the ordinary density pattern (20-10) is executed (step 20-10), follwed by a step (20-9). By the steps described so far, bias processing for forming the reference pattern is executed. It is to be noted that the step 20-9 is equivalent to the correction which occurs during usual copying operations, i.e., the degree of recovery of the drum 4 from fatigue is estimated and correction is executed by manipulating the bias voltage, for example.

Figure 21:
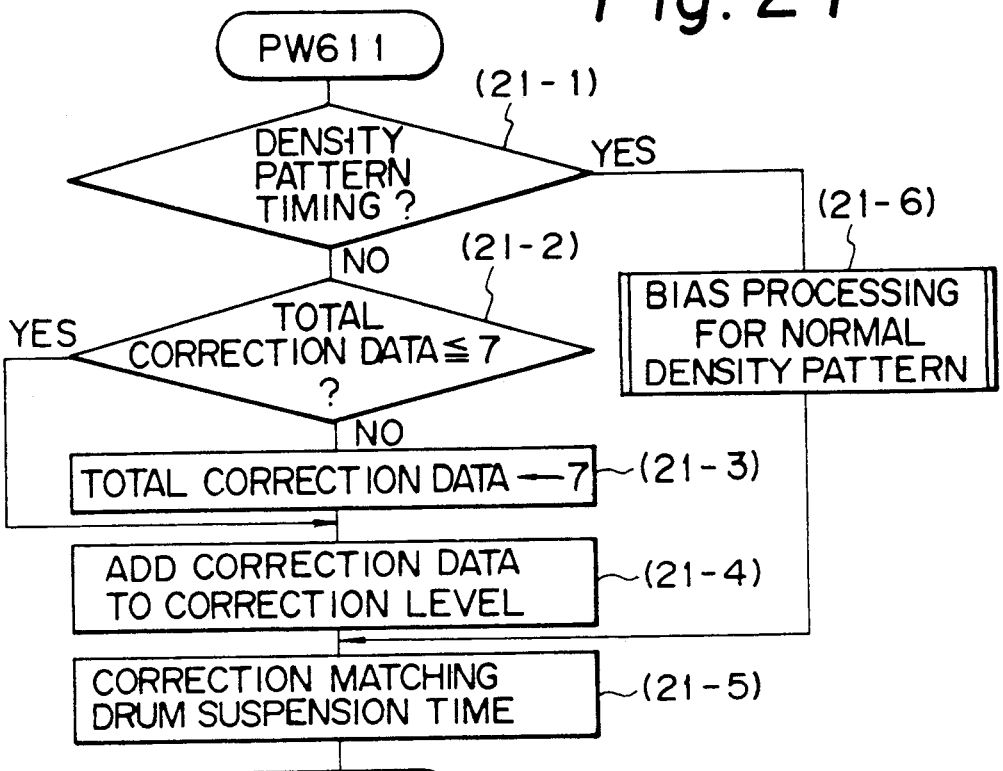

Subsequently, a routine PW611 shown in FIG. 10 is executed. As shown in FIG. 21, whether or not a density pattern timing has reached is determined (step 21-1). If the answer of the step 21-1 is NO, the program advances to a step 12-2 for determining whether or not the total correction data is equal to or greater than 7. If the answer of the step 21-2 is NO, the correction data is added to the correction level (step 21-4). This is followed by a step 21-5 for executing correction in relation to the drum suspension time, as in the step 20-9. If the answer of the step 21-2 is YES, the program directly advances to a step 21-5. In this manner, bias processing is executed at the time of formation of a comparison pattern.

Figure 22:
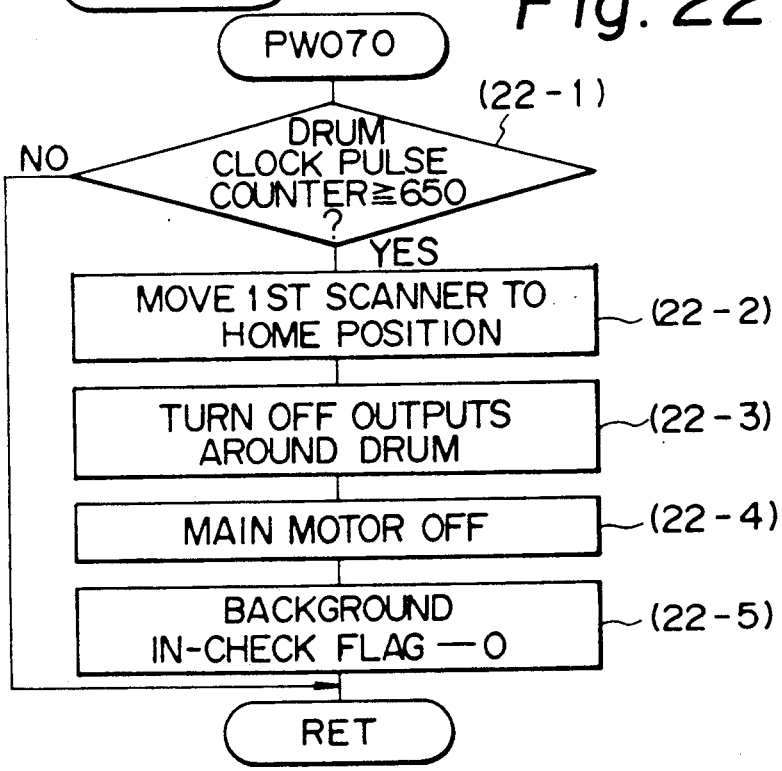

Next, a routine PW070 shown in FIG. 10 is executed. As shown in FIG. 22, if the drum clock pulse counter is equal to or greater than 650 (step 22-1), the first scanner 36 is moved to the home position (step 22-2), various outputs around the drum 4 are interrupted (step 22-3), the main motor 24 is deenergized (step 22-4), and the background in-check flag is turned to ZERO (step 22-5). This is the end of the checking procedure.

Figure 23:
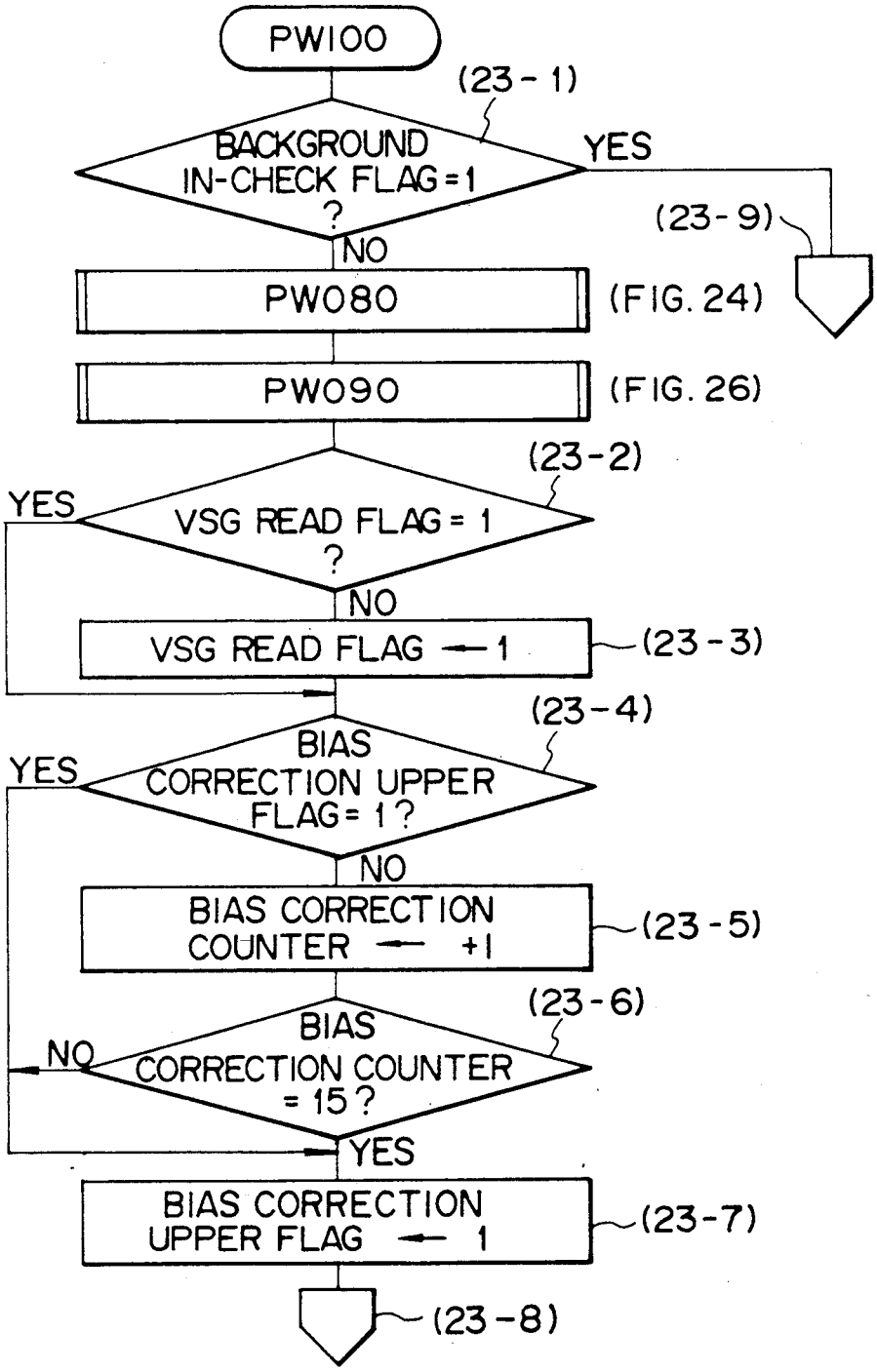
Figures 24, 24A:
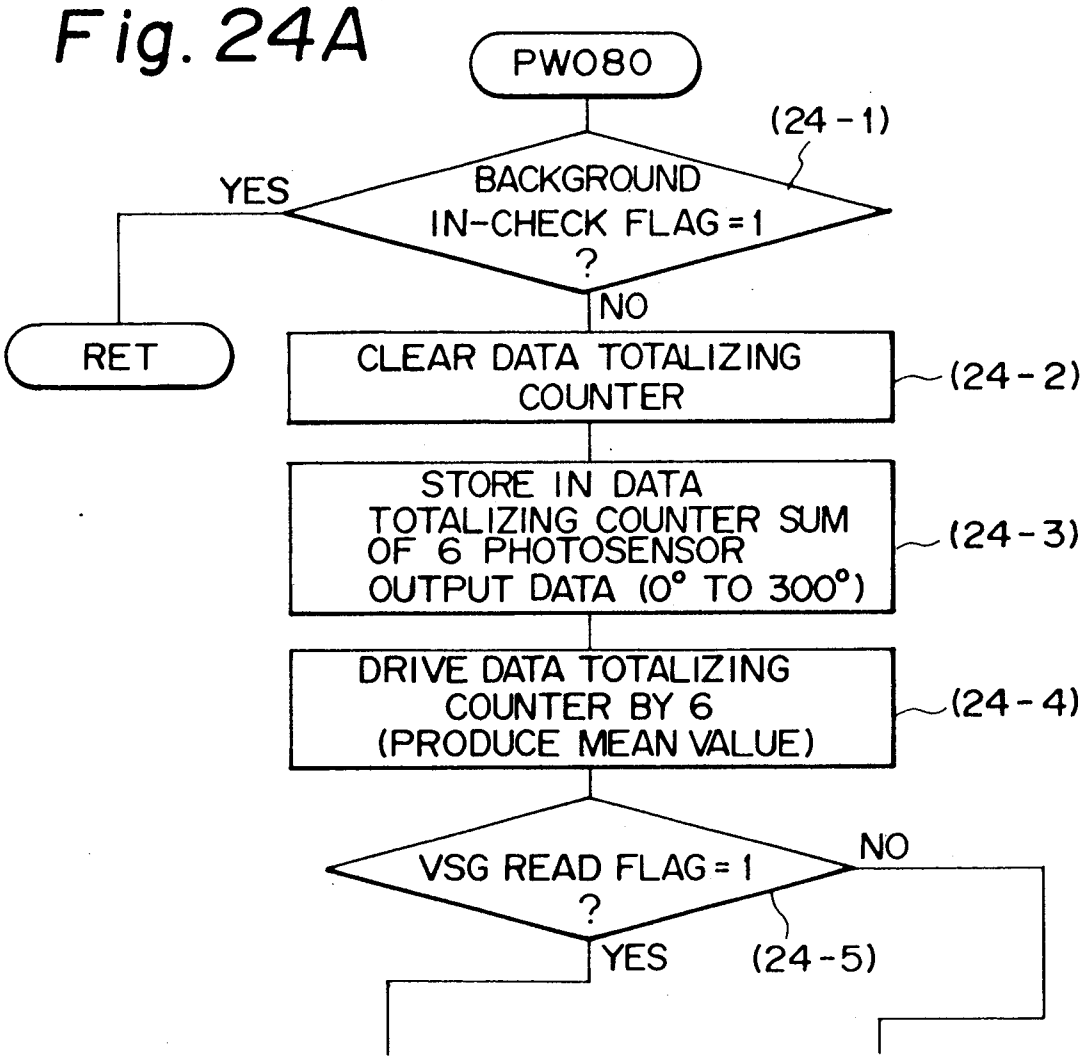
Figure 24B:
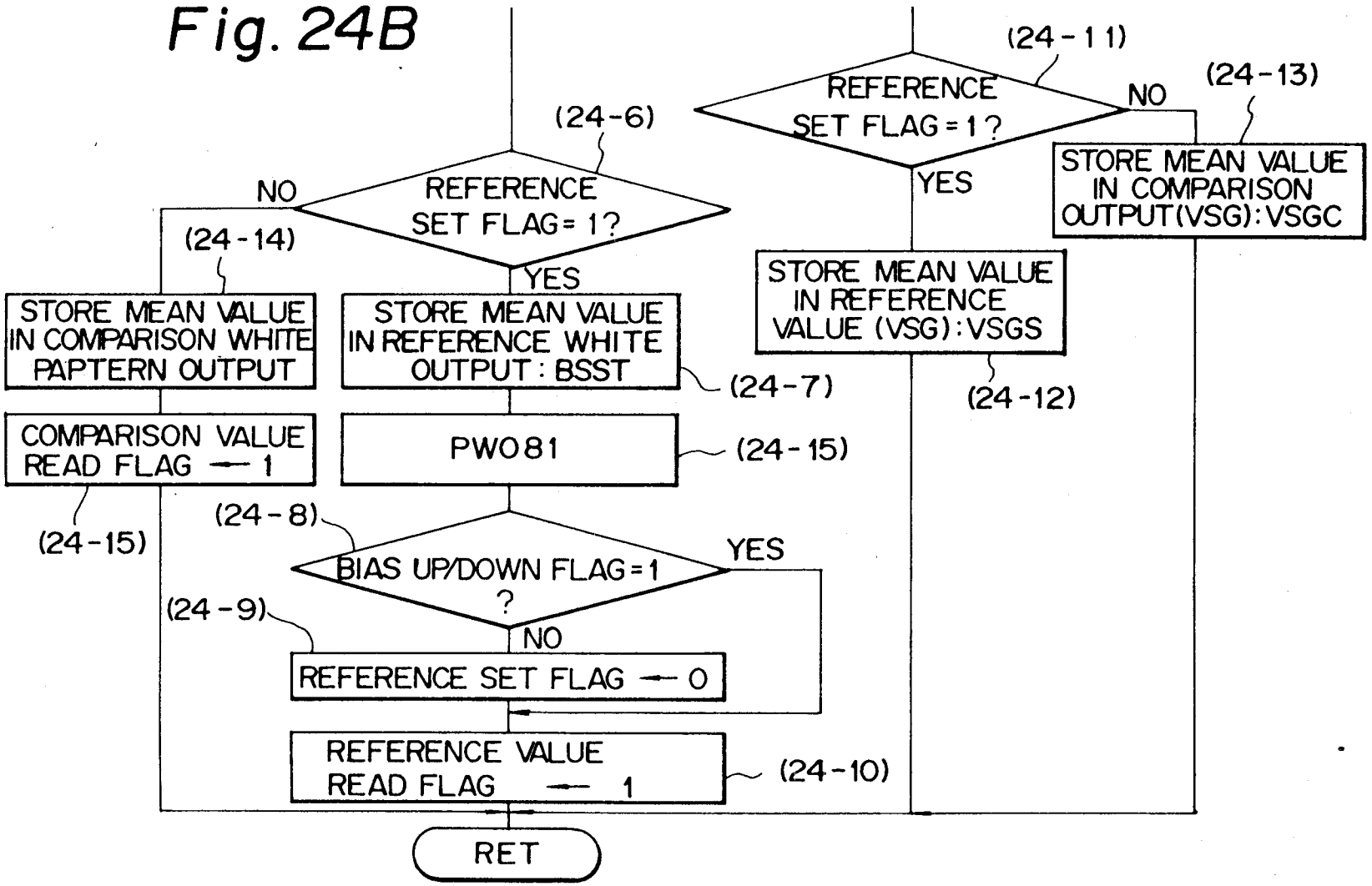

The routine PW070 is follows by a routine PW100. As shown in FIG. 23, if the background in-check flag is ONE (step 23-1), a loop 1 is executed (step 23-9) for continuing the sensing operation. If the answer of the step 23-1 is NO, processing PW080 is executed to average the outputs. As shown in FIG. 24, the processing PW080 begins with a step 24-1 for determining whether or not the background in-check flag is ONE. If the answer of the step 24-1 is NO, a counter for summing up the data is cleared (24-2), the sum of six photosensor output data (0 degrees to 300 degrees) is stored in the counter (step 24-3), the sum in the counter is divided by 6 to produce a mean value (step 24-4). Then, whether or not the VSG read flag is ONE is determined (step 24-5). If the answer of the step 24-5 is YES, whether or not a reference set flag is ONE is determined (step 24-6). If the answer of the step 24-6 is YES, the mean value is stored in the reference white pattern VSST (step 24-7). This is followed by processing PW080 for checking the reference output.

Figure 25:
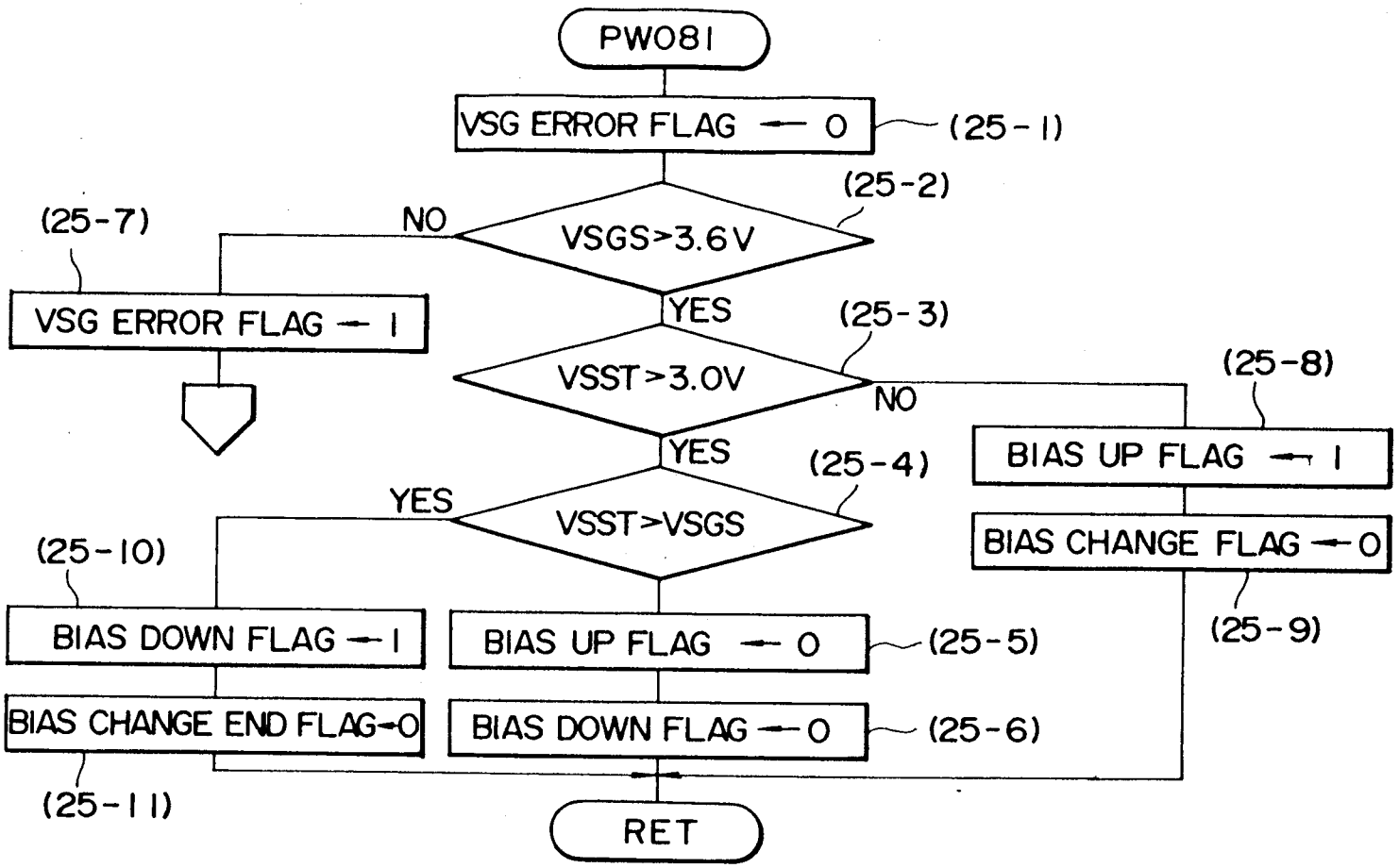

In FIG. 25, a VSG (background output) error flag is turned to ZERO (step 25-1). If the reference background output VSGS is equal to or higher than 3.6 volts (step 25-2), if the reference white pattern output VSST is equal to or higher than 3.0 volts (25-3), and if VSST is not equal to or higher than VSGS (25-4), the bias-up and bias-down flags are turned to ZERO (steps 25-5 and 25-6). On the other hand, if VSST is equal to or higher than VSGS (step 25-4), the bias-down flag is turned to ONE (step 25-10) and the bias change end flag is turned to ZERO (step 25-11). If VSGS is not equal to or higher than 3.6 volts (25-2), the background output VSG error flag is turned to ONE (step 25-7). If VSST is equal to or higher than 3.0 volts (step 25-3), the bias-up flag is turned to ONE (step 25-8) and the bias change end flag is turned to ZERO (25-9).

On the end of the procedure shown in FIG. 25, the program is transferred to a step 24-8 of FIG. 24 for determining whether or not the bias up/down flag is ONE. If the answer of the step 24-8 is NO, the reference set flag is turned to ZERO (step 24-9) and the reference read flag is turned to ONE (step 24-10). If the BSG read flag is not ONE (step 24-5), whether or not the reference set flag is ONE is determined (step 24-11). If the answer of the step 24-11 is YES, the mean value is stored in the reference background output VSG: VSGS (step 24-12); if otherwise, the mean value is stored in the comparison background output VSG: VSGC (step 24-13). If the reference set flag is not ONE (step 24-6), the mean value is stored in the comparison white pattern output: BSCK (step 24-14) and a comparison value read flag is turned to ONE (step 24-15).

Figure 26:
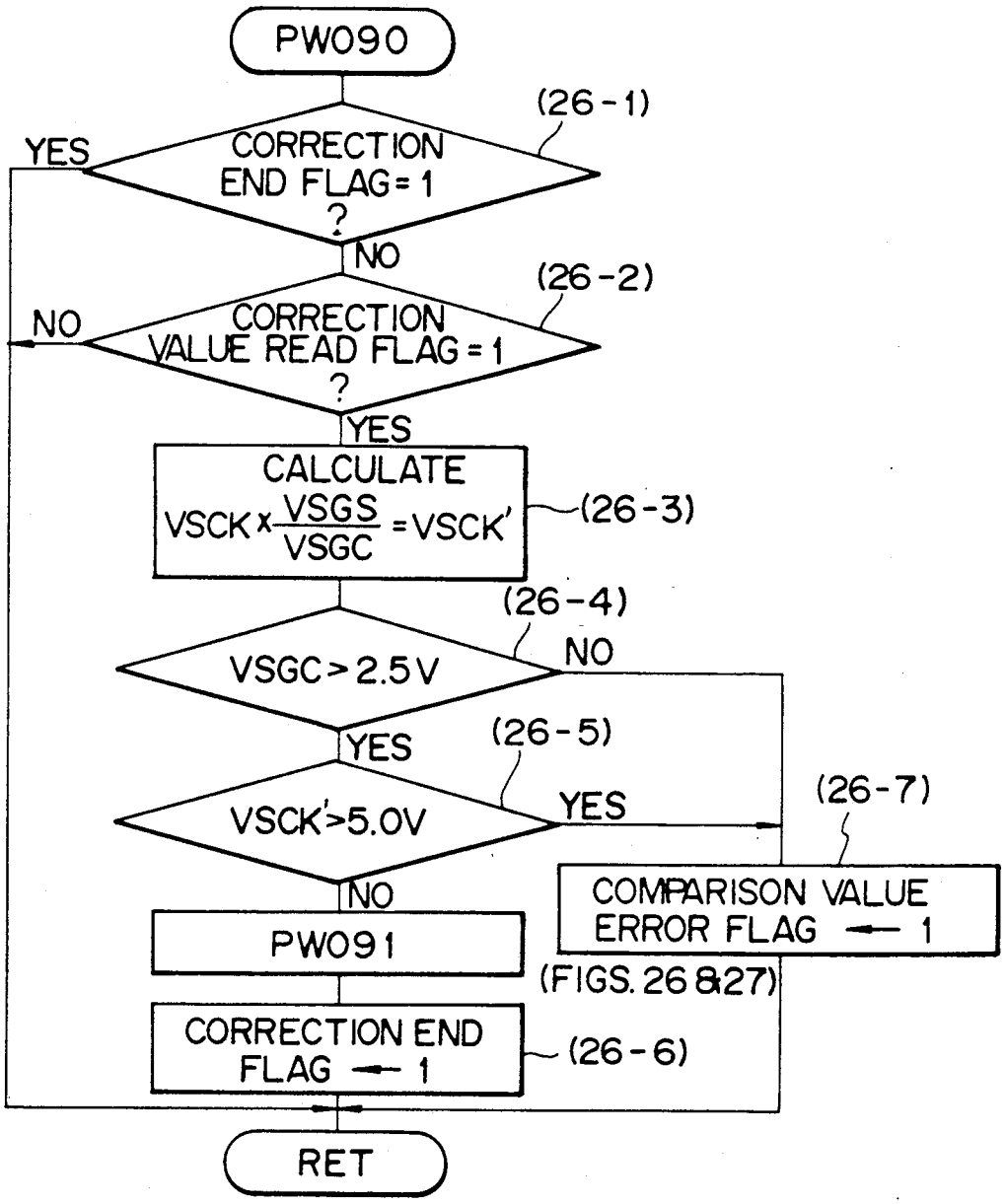

The sequence of steps shown in FIG. 24 is followed by processing PW090 shown in FIG. 26. Specifically, if a correction end flag is not ONE (step 26-1) and if a correction value read flag is ONE (step 26-2), $VSCK \times VSGC/VSGC - VSCK'$ is calculated (step 26-3). If VSGC is equal to or higher than 2.5 volts and if VSCK' is not equal to or higher than 5.0 vols (steps 26-4 and 26-5), processing PW091 is executed for determining a correction value $\Delta VB$.

Figures 27, 27A, 27B:
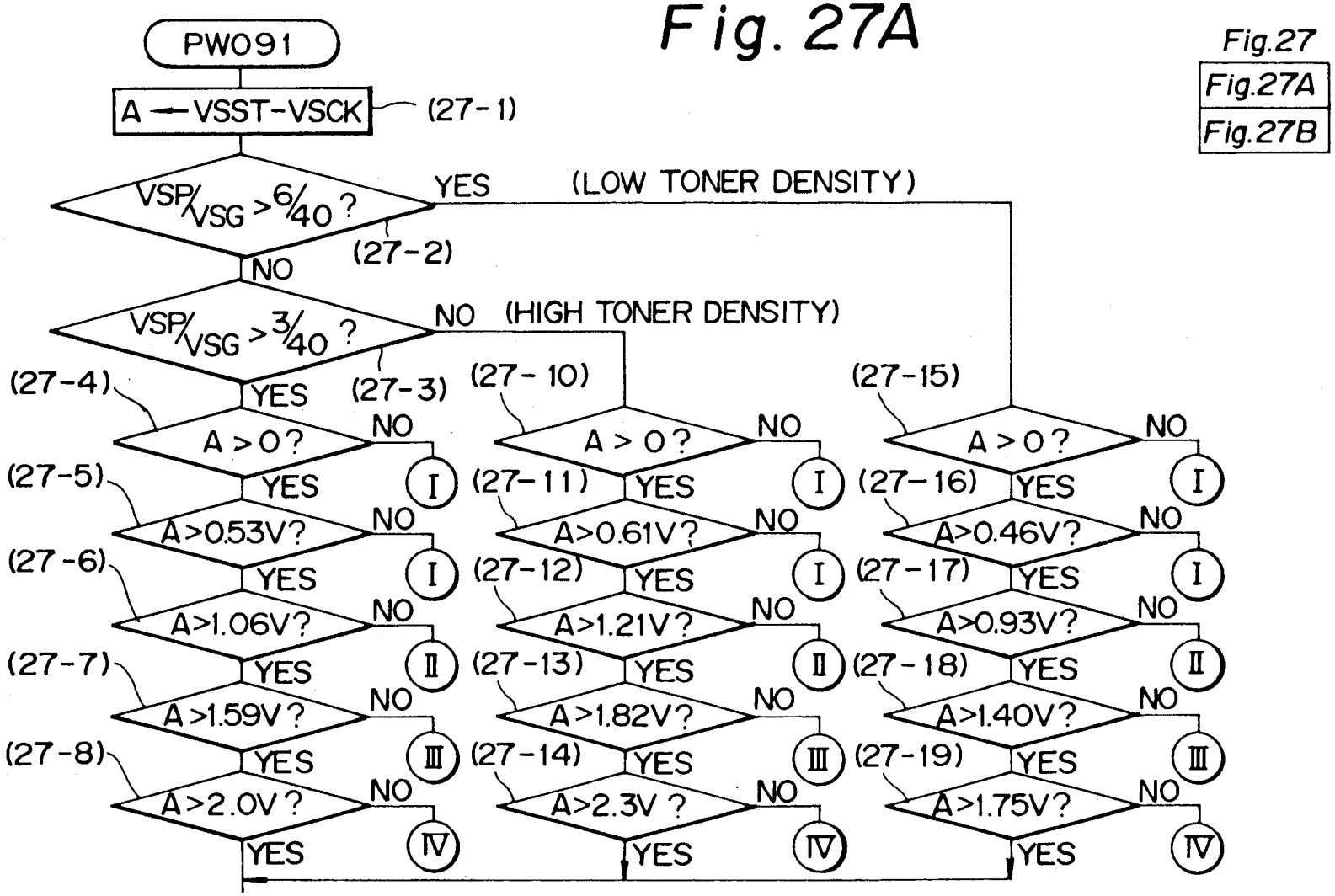
Figure 27B:
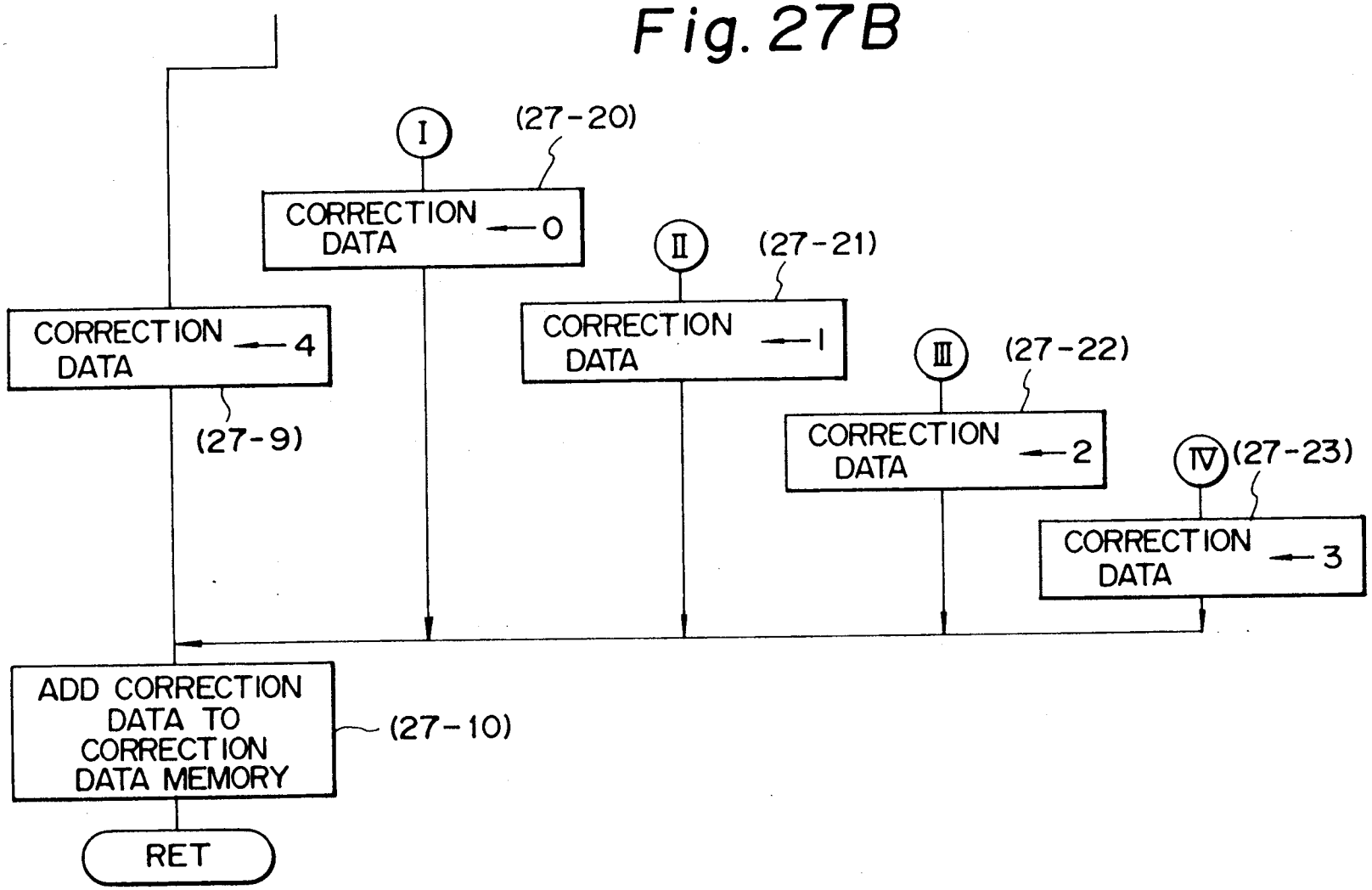

As shown in FIG. 27, the processing PW091 begins with a step 27-1 for setting a value for $VSST - VSCK'$ (step 27-1). This is followed by a step 27-2 for determining whether VSP/VSG is equal to or greater than 6/40. In this instance, VSP and VSG are the outputs of the photosensor 9 adapted for toner density control, i.e., usual outputs VSP and VSG of the photosensor 9 are detected during the background detection so as to change the correction data level by using them. If the answer of the step 27-2 is NO, whether or not VSP/VSG is equal to or greater than 3/40 is determined (step 27-3). If the answer of the step 27-3 is YES, whether the above-mentioned value A is lower than 0.53 volts is determined. If the value is lower than 0.53 volts, the operation is transferred to I (steps 27-4 and 27-5). If A is higher than 0.53 volts and equal to or lower than 1.06 volts, the operation is transferred to II (step 27-6). If A is higher than 1.06 volts and equal to or lower 1.59 volts, the operation is transferred to III (step 27-7). If A is higher than 1.59 volts and equal to or lower than 2.0 vols, the operation is transferred to IV (step 27-8). Further, if A is higher than 2.0 volts, 4 is entered in the correction data (27-9). This correction data is added to the correction data memory (27-10).

If the answer of the step 27-2 is YES, meaning that the toner density is low, the program is transferred to I if A is equal to or lower than 0.46 volts (steps 27-15 and 27-16), transferred to II if A is higher than 0.46 volt and equal to or lower than 0.93 volt (step 27-17), transferred to III if A is higher than 0.93 volt and equal to or lower than 1.40 volts (step 28-18), and transferred to IV if A is higher than 1.40 volts and equal to or lower than 1.75 volts (step 27-19). Further, if A is higher than 1.75 volts, the step 27-9 is executed.

If the answer of the step 27-3 is NO, meaning that the toner density is high, the program is transferred to I if A is equal to or lower than 0.61 volt (steps 27-10 and 27-11), transferred to II if A is higher than 0.61 volt and equal to or lower than 1.21 volts (step 27-12), transferred to III if A is higher than 1.21 volts and equal to or lower than 1.82 volts (step 27-13), and to IV if A is higher than 1.82 volts and equal to or lower than 2.3 volts (step 27-14). Further, if A is higher than 2.3 volts, the step 27-9 is executed.

Correction data 0, 1, 2 and 3 are inputted in the correction data by the above-mentioned I, II, III and IV (steps 27-20, 27-21, 27-22 and 27-23), respectively. Thereafter, the correction data is processed in a step 27-10. The numerical values 0 to 4 to be inputted in the correction data are representative of the bias output steps; one step corresponds to an output step (×15 to 30).

Figure 28:
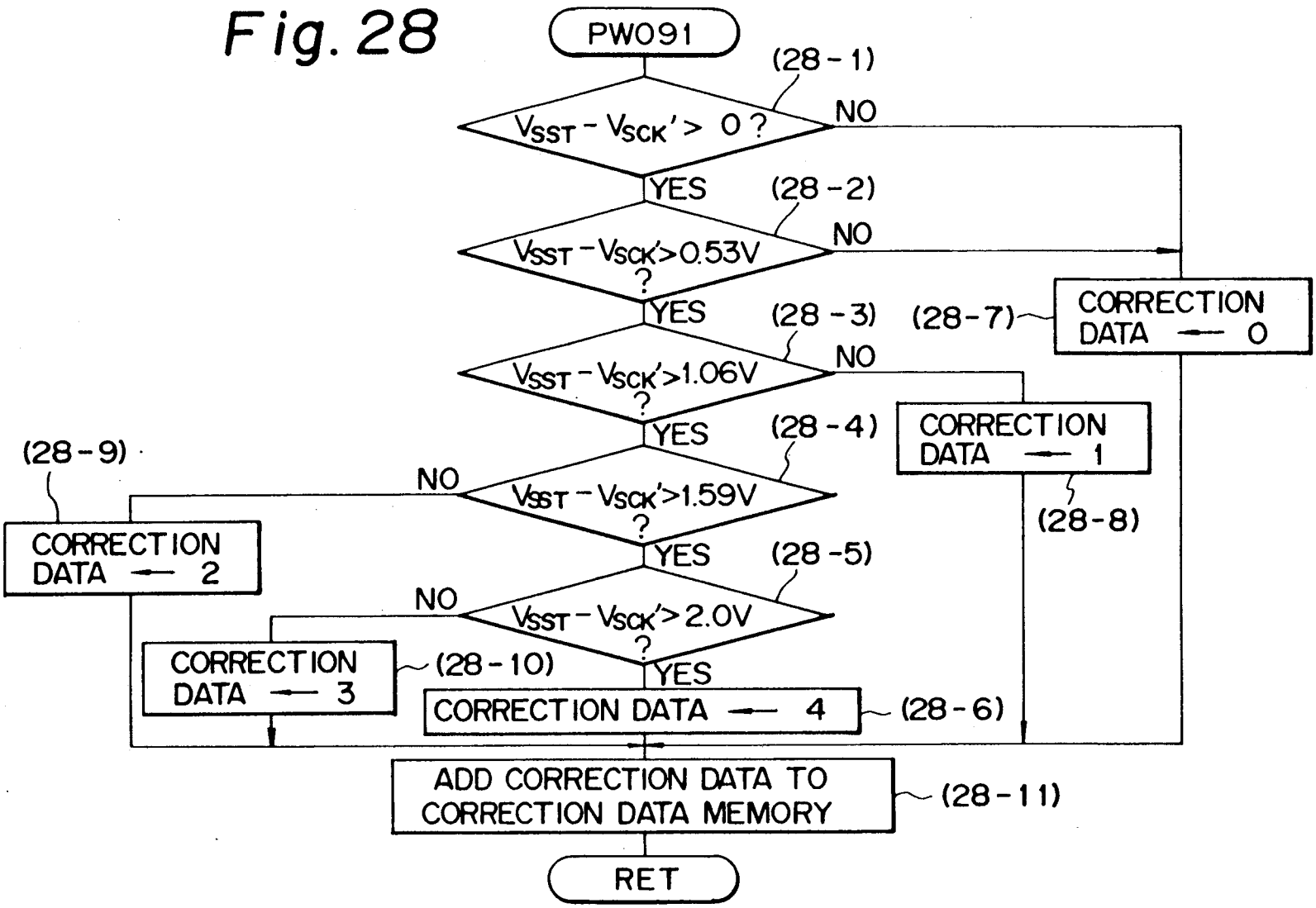

The processing PW091 shown in FIG. 27 takes account of the toner density pattern output. FIG. 28 shows a sequence of steps which do not take the toner density pattern into consideration. In FIG. 28, whether or not VSST−VSCK′ is greater than 0 is determined (step 28-1). If the answer of the step 28-1 is YES, whether or not VSST−VSCK′ is higher than 0.53 volt is determined (28-2). If the answer of the step 28-2 is YES, whether or not BSST−VSCK′ is higher than 1.06 volts is determined (step 28-3). If the answer of the step 28-3 is YES, whether VSST−VSCK′ is higher than 1.59 volts is determined (step 28-4). If the answer of the step 28-4 is YES, whether or not VSST−VSCK′ is higher than 2.0 volts is determined (step 28-5). If the answer of the step 28-5 is YES, 4 is inputted in the correction data (step 28-6). If the answer of the step 28-1 or that of the step 28-2 is NO, 0 is inputted in the correction data (step 28-7). If the answer of the step 28-3 is NO, 1 is inputted in the correction data 1 (step 28-8). If the answer of the step 28-4 is NO, 2 is inputted in the correction data (step 28-9). Futher, if the answer of the step 28-5 is NO, 3 is inputted in the correction data (step 28-10). In a step S28-11, such correction data is added to the bias voltage for development which will be applied during usual copying operations.

On the completion of the procedure shown in FIG. 27 or 28, the program advances to a step 26-6 shown in FIG. 26 for turning the correction end flag to ONE. If VSGC is not equal to or higher than 2.5 volts (step 26-4) or if VSCK′ is equal to or higher than 5.0 volts (step 26-5), a comparison value error flag is turned to ONE (step 26-7). By such a procedure, the comparison background output VSGC is corrected. The procedure of FIG. 26 is followed by the step 23-2 of FIG. 23 to see if the VSG read flag is ONE. If the answer of the step 23-2 is NO, the VSG read flag is turned to ONE (step 23-3). If a bias upper limit flag is not ONE (step 23-4), a bias correction counter is incremented by 1 (step 23-5). If the bias correction counter is 15 (step 23-6), the bias correction upper flag is turned to ONE (step 23-7), and then a step 23-8, i.e., a loop 2 of FIG. 10 is executed.

While in the illustrative embodiment the black pattern is read while the scanner is in a forward movement, it may alternatively be read during a backward movement of the scanner or even during both of the forward and backward movements. Dividing the circumference of the drum 4 into six equal segments as shown and described is only illustrative. The gist is that the photosensor outputs are associated with a pluality of positions on the circumference of the drum 4 and are averaged. For averaging the photosensor outputs, any one of known implementations such as simple averaging and averaging with the highest and lowest values being cut may be used. Although the illustrative embodiment has concentrated on a bias voltage for development, the present invention is practicable with any other image forming conditions such as the amount of charge and that of illumination.

In summary, in accordance with the present invention, a plurality of patterns for controlling image forming conditions can be formed on a photoconductive element. The present invention, therefore, insures accurate correction of toner density and background output by reducing the influence of the eccentricity of the photoconductive element, for example, on outputs of a sensor associated with the patterns.

Various modifications will become possible for those skilled in the art after receiving the teachings of the present disclosure without departing from the scope thereof.

What is claimed is:

1. An image density control method for an image forming apparatus having optics which includes a scanner for forming an exclusive pattern having a predetermined density on an image carrier and controlling an image forming condition on the basis of said exclusive pattern, said method comprising the steps of:

(a) preparing a plurality of exclusive patterns for controlling the image forming condition, said patterns including a high density black pattern and a low density white pattern;

(b) moving the scanner of the optics to s predetermined position and stopping said scanner at said predetermined position;

(c) electrostatically forming a latent image representative of said low density white pattern on the circumference of the image carrier while the scanner is stopped; p1 (d) causing the scanner to reciprocate between said predetermined position and a scanner home position; and (e) electrostatically forming a latent image representative of said high density black pattern on the image carrier while the scanner reciprocates.

2. A method as claimed in claim 1, wherein step (a) comprises:

(f) arranging said plurality of patterns in parallel with an intended direction of movement of the scanner.

3. A method as claimed in claim 1, wherein step (b) comprises:

(f) defining said predetermined position at a position furthest from said scanner home position.

4. A method as claimed in claim 1, wherein said step (c) comprises: p1 forming a latent image of said low density white pattern on the circumferences of the image carrier as a continuous one-round pattern.

5. A method as claimed in claim 4, further comprising the steps of:

(f) developing said latent image of said low density white pattern; and (g) sensing a density of said developed low density white pattern at a plurality of positions on the circumference of the image carrier.

6. A method as claimed in claim 1, wherein said step (c) comprises:

forming a latent image of said low density white pattern on the circumferences of the image carrier as a plurality of equally spaced segments.

7. A method as claimed in claim 6, further comprising the steps of:

(f) developing said latent image of said low density white pattern having said equally spaced segments; and (g) sensing a density of said developed segments.

* * * * *